US009626912B2

(12) United States Patent
Kim et al.

(10) Patent No.: US 9,626,912 B2
(45) Date of Patent: Apr. 18, 2017

(54) ELECTROLUMINESCENT DISPLAY AND METHOD OF DRIVING THE SAME

(71) Applicant: Samsung Display Co. Ltd., Yongin, Gyeonggi-Do (KR)

(72) Inventors: Jung-Taek Kim, Seoul (KR); Joon-Chul Goh, Hwaseong-si (KR); Soo-Yeon Lee, Hwaseong-si (KR); Kyoung-Ho Lim, Suwon-si (KR); Young-Woo Choi, Suwon-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 114 days.

(21) Appl. No.: 14/788,553

(22) Filed: Jun. 30, 2015

(65) Prior Publication Data

US 2016/0217729 A1 Jul. 28, 2016

(30) Foreign Application Priority Data

Jan. 28, 2015 (KR) ..... 10-2015-0013441

(51) Int. Cl.
*G09G 3/30* (2006.01)
*G09G 3/3266* (2016.01)
(Continued)

(52) U.S. Cl.
CPC ..... *G09G 3/3266* (2013.01); *G09G 3/3233* (2013.01); *G09G 3/2022* (2013.01);
(Continued)

(58) Field of Classification Search
CPC ..... G09G 3/30; G09G 3/2022; G09G 3/3266; G09G 3/3233; G09G 2310/021; G09G 2310/0218
(Continued)

(56) References Cited

U.S. PATENT DOCUMENTS 8,487,843 B2 * 7/2013 Goh ..... G09G 3/3233 315/169.3
8,872,737 B2 * 10/2014 Shin ..... G09G 3/3208 345/690
(Continued)

FOREIGN PATENT DOCUMENTS

KR 10-2006-0078675 A 7/2006
KR 10-2012-0028426 A 3/2012
(Continued)

*Primary Examiner* — Vijay Shankar
(74) *Attorney, Agent, or Firm* — Knobbe Martens Olson & Bear LLP

(57) ABSTRACT

An electroluminescent display and a method of driving the same are disclosed. In one aspect, the display includes a display panel including a plurality of pixel units electrically connected to a plurality of data lines and a plurality of gate lines. The pixel units are arranged in a matrix of a plurality of rows and a plurality of columns, the pixel units in the same column are connected to the same data line, and the pixel units in the same diagonal line of the matrix are connected to the same gate line. The display also includes a data driver located at a first side of the display panel, the data driver being configured to drive the data lines, and a gate driver located at the first side of the display panel and configured to drive the gate lines.

16 Claims, 20 Drawing Sheets

(51) Int. Cl.
*G09G 3/3233* (2016.01)
*G09G 3/20* (2006.01)

(52) U.S. Cl.
CPC ..... *G09G 2300/0426* (2013.01); *G09G 2310/021* (2013.01); *G09G 2310/0218* (2013.01); *G09G 2310/0221* (2013.01)

(58) Field of Classification Search
USPC ..... 345/76–83, 93–100
See application file for complete search history.

(56) References Cited

U.S. PATENT DOCUMENTS 8,933,867 B2 * 1/2015 Yoon ..... H01L 27/3276 345/76
9,268,428 B2 * 2/2016 Kim ..... G06F 3/0412
9,478,169 B2 * 10/2016 Lim ..... G09G 3/3258

FOREIGN PATENT DOCUMENTS

KR 10-2013-0136688 A 12/2013
KR 10-2014-0001607 A 1/2014
KR 10-2015-0133934 A 12/2015

* cited by examiner

FIG. 11

| ROW | UNIT1 | | | | UNIT2 | | | | UNIT3 | | | | UNIT4 | | | | UNIT5 | | | | UNIT6 | | | |
|---|---|---|---|---|---|---|---|---|---|---|---|---|---|---|---|---|---|---|---|---|---|---|---|---|
| 1 | ① | 1 | 1 | 1 | 1 | 1 | 1 | 1 | 1 | 1 | 1 | 1 | 1 | ② | 2 | 2 | 2 | 2 | 2 | ③ | 3 | 3 | ④ | 4 |
| 2 | 3 | 3 | ④ | 4 | ① | 1 | 1 | 1 | 1 | 1 | 1 | 1 | 1 | 1 | 1 | 1 | 1 | ② | 2 | 2 | 2 | 2 | 2 | ③ |
| 3 | 2 | 2 | 2 | ③ | 3 | 3 | ④ | 4 | ① | 1 | 1 | 1 | 1 | 1 | 1 | 1 | 1 | 1 | 1 | 1 | 1 | ② | 2 | 2 |
| 4 | 1 | ② | 2 | 2 | 2 | 2 | 2 | ③ | 3 | 3 | ④ | 4 | ① | 1 | 1 | 1 | 1 | 1 | 1 | 1 | 1 | 1 | 1 | 1 |
| 5 | 1 | 1 | 1 | 1 | 1 | ② | 1 | 2 | 2 | 2 | 2 | ③ | 3 | 3 | ④ | 4 | ① | 1 | 1 | 1 | 1 | 1 | 1 | 1 |
| 6 | 1 | 1 | 1 | 1 | 1 | 1 | 1 | 1 | 1 | ② | 2 | 2 | 2 | 2 | 2 | ③ | 3 | 3 | ④ | 4 | ① | 1 | 1 | 1 |

ELECTROLUMINESCENT DISPLAY AND METHOD OF DRIVING THE SAME

CROSS REFERENCE TO RELATED APPLICATION

This application claims priority under 35 U.S.C. §119 to Korean Patent Application No. 10-2015-0013441 filed on Jan. 28, 2015, in the Korean Intellectual Property Office (KIPO), the disclosure of which is hereby incorporated by reference in its entirety.

BACKGROUND

Field

The described technology generally relates to an electroluminescent display and a method of driving the same.

Description of the Related Technology

Recently, various display devices such as liquid crystal displays, plasma display devices, and electroluminescent displays have gained popularity. An electroluminescent display can be driven with quick response speed and reduced power consumption, using light-emitting diodes (LEDs) or organic light-emitting diodes (OLEDs) that emit light through recombination of electrons and holes.

This type of display can be driven with an analog driving method or a digital driving method. While the analog driving method produces grayscale using variable voltage levels corresponding to input data, the digital driving method produces grayscale using variable time duration in which the LED emits light. The analog driving method is difficult to implement because it requires a driving integrated circuit (IC) that is complicated to manufacture if the display has a sufficiently large size and high resolution. The digital driving method, on the other hand, can readily accomplish the required high resolution through a simpler IC structure. As the size and the resolution of an electroluminescent display increases, the digital driving method becomes more desirable than the analog driving method.

SUMMARY OF CERTAIN INVENTIVE ASPECTS

One inventive aspect relates to an electroluminescent display that can perform a single-side driving efficiently and a method of single-side driving for an electroluminescent display.

Another aspect is an electroluminescent display that includes a display panel, a data driver and a gate driver. The display panel includes a plurality of pixel units connected to a plurality of data lines and a plurality of gate lines and the plurality of pixel units are arranged in a matrix form of a plurality of rows and a plurality of columns. The pixel units in the same column are connected commonly to the same data line, and the pixel units in the same diagonal line are connected commonly to the same gate line. The data driver is formed at one side of the display panel, and the data driver is configured to drive the data lines. The gate driver is formed at the one side of the display panel together with the data driver, and the gate driver is configured to drive the gate lines.

The pixel units can be arranged in the matrix form of the m rows and the n columns where m is a positive integer and n is a positive integer greater than m, and the pixel units in the (i)-th row and in the (j)-th column can be connected commonly to the (i+j−1)-th gate line where i is a positive integer equal to or smaller than m and j is a positive integer equal to or smaller than n.

Each of the first gate line through (n)-th gate line can include a first diagonal gate line that is connected to the gate driver at a top side of the display panel and extended in a diagonal direction, and each of the (n+1)-th gate line through the (m+n−1)-th gate line can include a vertical gate line that is connected to the gate driver at the top side of the display panel and extended in a column direction and a second diagonal line that is connected to the vertical gate line at a bottom side of the display panel and extended in the diagonal direction.

The first gate line through the (m+n−1)-th gate line can be grouped into a first group including the first gate line through the (n−m)-th gate line, a second group including the (n−m+1)-th gate line through the (n)-th gate line and a third group including the (n+1)-th gate line through the (n+m−1)-th gate line.

The gate driver can include a first gate driver configured to drive the gate lines of the first group and a second gate driver configured to drive the gate lines of the second and third groups.

The first and second gate drivers can commonly receive a scan address signal and a latch clock signal to drive and activate one gate line of the first, second and third groups for each scan period.

The first and second gate drivers can drive the gate lines of the first, second and third groups in progressive emission with simultaneous scan (PESS) scheme.

Activation times of the first gate line through the (m+n−1)-th gate line can be equal to each other.

Activation times of the first gate line through the (m+n−1)-th gate line can be varied depending on loads of the gate lines.

Valid data signals can be applied to a portion of the data lines and dummy data signals can be applied to the other data lines for each scan period.

The first gate driver can receive a first scan address signal and a first latch clock signal to drive and activate one gate line of the first group for each scan period, and the second gate driver can receive a second scan address signal and a second latch clock signal to drive and activate one gate line of the second and third groups for each scan period.

The first gate driver can drive the gate lines of the first group in PESS scheme, and the second driver can drive the gate lines of the second group in PESS scheme and simultaneously drive the gate lines of the third group in PESS scheme.

The second driver can divide each scan period into a first half scan period and a second half scan period to drive and activate one gate line of the second group during the first half scan period and to drive and activate one gate line of the third group during the second half scan period.

The second gate driver can overlap at least a portion of an activation time of the gate line of the second group and at least a portion of an activation time of the gate line of the third group for each scan period.

Valid data signals can be applied to all of the data lines for each scan period.

Each data line can include a red data line, a green data line and a blue data line. Each pixel unit can include a red sub pixel connected to the red data line, a green sub pixel connected to the green data line and a blue sub pixel connected to the blue data line. The red sub pixel, the green sub pixel and the blue sub pixel in the same unit pixel can be connected commonly to the same gate line.

Another aspect is a method of single-side driving for an electroluminescent display is provided. The electroluminescent display device includes a display panel, and the display panel includes a plurality of pixel units that are connected to a plurality of data lines and a plurality of gate lines and arranged in a matrix form of a plurality of rows and a plurality of columns. The method includes connecting the pixel units in the same column commonly to the same data line, connecting the pixel units in the same diagonal line commonly to the same gate line, driving the data lines with a data driver formed at one side of the display panel and driving the gate lines with a gate driver formed at the one side of the display panel together with the data driver.

The pixel units can be arranged in the matrix form of the m rows and the n columns where m is a positive integer and n is a positive integer greater than m. Connecting the pixel units in the same diagonal line commonly to the same gate line can include connecting the pixel units in the (i)-th row and in the (j)-th column commonly to the (i+j−1)-th gate line where i is a positive integer equal to or smaller than m and j is a positive integer equal to or smaller than n.

Each of the first gate line through (n)-th gate line can include a first diagonal gate line that is connected to the gate driver at a top side of the display panel and extended in a diagonal direction, and each of the (n+1)-th gate line and the (m+n−1)-th gate line can include a vertical gate line that is connected to the gate driver at the top side of the display panel and extended in a column direction and a second diagonal line that is connected to the vertical gate line at a bottom side of the display panel and extended in the diagonal direction.

The first gate line through the (m+n−1)-th gate line can be grouped into a first group including the first gate line through the (n−m)-th gate line, a second group including the (n−m+1)-th gate line through the (n)-th gate line and a third group including the (n+1)-th gate line through the (n+m−1)-th gate line. Driving the gate lines can include connecting the first group to a first gate driver to drive the gate lines of the first group and connecting the second and third groups to a second gate driver to drive the gate lines of the second and third groups.

Another aspect is an electroluminescent display comprising: a display panel including a plurality of pixel units electrically connected to a plurality of data lines and a plurality of gate lines, wherein the pixel units are arranged in a matrix of a plurality of rows and a plurality of columns, wherein the pixel units in the same column are connected to the same data line, and wherein the pixel units in the same diagonal line of the matrix are connected to the same gate line; a data driver located at a first side of the display panel, wherein the data driver is configured to drive the data lines; and a gate driver located at the first side of the display panel and configured to drive the gate lines.

In the above electroluminescent display, the rows include m rows, wherein the columns include n columns where m is a positive integer and n is a positive integer greater than m, and wherein the pixel units in the (i)-th row and in the (j)-th column are electrically connected to the (i+j−1)-th gate line where i is a positive integer equal to or less than m, and j is a positive integer equal to or less than n.

In the above electroluminescent display, the gate lines include an (n)-th gate line and an (m+n−1)-th gate line, wherein each of the first through (n)-th gate lines respectively includes a plurality of portions of a first diagonal gate line, wherein the first diagonal gate line is connected to the gate driver at the first side of the display panel and extends in a diagonal direction, wherein each of the (n+1)-th gate line through the (m+n−1)-th gate line respectively includes i) a plurality of portions of a vertical gate line, wherein the vertical gate line is connected to the gate driver at the first side of the display panel and extends in a column direction and ii) a plurality of portions of a second diagonal line, wherein the second diagonal line is connected to the vertical gate line at a second side of the display panel and extends in the diagonal direction, and wherein the second side opposes the first side.

In the above electroluminescent display, the first gate line through the (m+n−1)-th gate line are grouped into a first group including the first gate line through the (n−m)-th gate line, a second group including the (n−m+1)-th gate line through the (n)-th gate line, and a third group including the (n+1)-th gate line through the (n+m−1)-th gate line.

In the above electroluminescent display, the gate driver includes: a first gate driver configured to drive the gate lines of the first group; and a second gate driver configured to drive the gate lines of the second and third groups.

In the above electroluminescent display, the first and second gate drivers are configured to receive the same scan address signal and latch clock signal to drive and activate a selected gate line of the first, second and third groups during a scan period.

In the above electroluminescent display, the first and second gate drivers are configured to drive the gate lines of the first, second and third groups in progressive emission with simultaneous scan (PESS) scheme.

In the above electroluminescent display, activation times of the first gate line through the (m+n−1)-th gate line are substantially equal to each other.

In the above electroluminescent display, activation times of the first gate line through the (m+n−1)-th gate line vary based on loads on the gate lines.

In the above electroluminescent display, the data driver is further configured to i) provide one or more valid data signals to one or more of the data lines and ii) provide one or more dummy data signals to the other data lines during a scan period.

In the above electroluminescent display, the first gate driver is further configured to receive a first scan address signal and a first latch clock signal to drive and activate a selected gate line of the first group during a scan period, wherein the second gate driver is further configured to receive a second scan address signal and a second latch clock signal to drive and activate a selected gate line of the second and third groups during the scan period.

In the above electroluminescent display, the first gate driver is further configured to drive the gate lines of the first group in the progressive emission with simultaneous scan (PESS) scheme, wherein the second driver is configured to concurrently drive the gate lines of the second and third groups in the PESS scheme.

In the above electroluminescent display, the second driver is further configured to divide the scan period into first and second half scan periods, wherein the second driver is further configured to i) drive and activate a selected gate line of the second group during the first half scan period and ii) drive and activate a selected gate line of the third group during the second half scan period.

In the above electroluminescent display, at least a portion of an activation time of the gate line of the second group and at least a portion of an activation time of the gate line of the third group overlap during a scan period.

In the above electroluminescent display, the data driver is further configured to provide a plurality of valid data signals to all of the data lines during a scan period.

In the above electroluminescent display, each data line includes red, green and blue data lines, wherein each pixel unit includes red, green and blue sub pixels respectively connected to the red, green and blue data lines, and wherein the red, green and blue sub pixels in the same unit pixel are connected to the same gate line.

Another aspect is a method of driving an electroluminescent display device comprising a plurality of pixel units connected to a plurality of data lines and a plurality of gate lines and arranged in a matrix form of a plurality of rows and the columns, the method comprising: electrically connecting the pixel units in the same column to the same data line; electrically connecting the pixel units in the same diagonal line of the matrix to the same gate line; driving the data lines with a data driver located at a first side of a display panel of the electroluminescent display; and driving the gate lines with a gate driver located at the first side of the display panel.

In the above method, the rows include m rows, wherein the columns include n columns where m is a positive integer and n is a positive integer greater than m, and wherein the electrical connecting of the pixel units in the same diagonal line includes: electrically connecting the pixel units in a (i)-th row and in a (j)-th column to a (i+j−1)-th gate line where i is a positive integer equal to or less than m and j is a positive integer equal to or less than n.

In the above method, the gate lines include an (n)-th gate line and an (m+n−1)-th gate line, wherein each of the first through (n)-th gate lines respectively includes a plurality of portions of a first diagonal gate line, wherein the first diagonal gate line is connected to the gate driver at the first side of the display panel and extends in a diagonal direction, and wherein each of the (n+1)-th gate line and the (m+n−1)-th gate line respectively includes i) a plurality of portions of a vertical gate line, wherein the vertical gate line is connected to the gate driver at the first side of the display panel and extends in a column direction and ii) a plurality of portions of a second diagonal line, wherein the second diagonal line is connected to the vertical gate line at a second side of the display panel and extends in the diagonal direction.

In the above method, the first gate line through the (m+n−1)-th gate line are grouped into a first group including the first gate line through the (n−m)-th gate line, a second group including the (n−m+1)-th gate line through the (n)-th gate line, and a third group including the (n+1)-th gate line through the (n+m−1)-th gate line, and wherein the driving of the gate lines includes: electrically connecting the first group to a first gate driver to drive the gate lines of the first group; and electrically connecting the second and third groups to a second gate driver to drive the gate lines of the second and third groups.

According to at least one of the disclosed embodiments, the electroluminescent display and the single-side driving method reduce the bezel width by disposing the data driver and the gate driver together at the same side of the display panel.

The electroluminescent display and the single-side driving method can improve degradation of image quality at a right-bottom portion of the display panel by adopting the digital driving method that represents grayscale through light emission time instead of magnitude of a driving voltage.

The electroluminescent display and the single-side driving method can reduce data rate and secure charging time by grouping the pixel units in the display panel that is driven by the single-side driving method.

BRIEF DESCRIPTION OF THE DRAWINGS

FIGS. 9, 10 and 11 are diagrams illustrating a method of single-side driving using the gate driver of FIG. 8 according to example embodiments.

DETAILED DESCRIPTION OF CERTAIN INVENTIVE EMBODIMENTS

Figure 1:
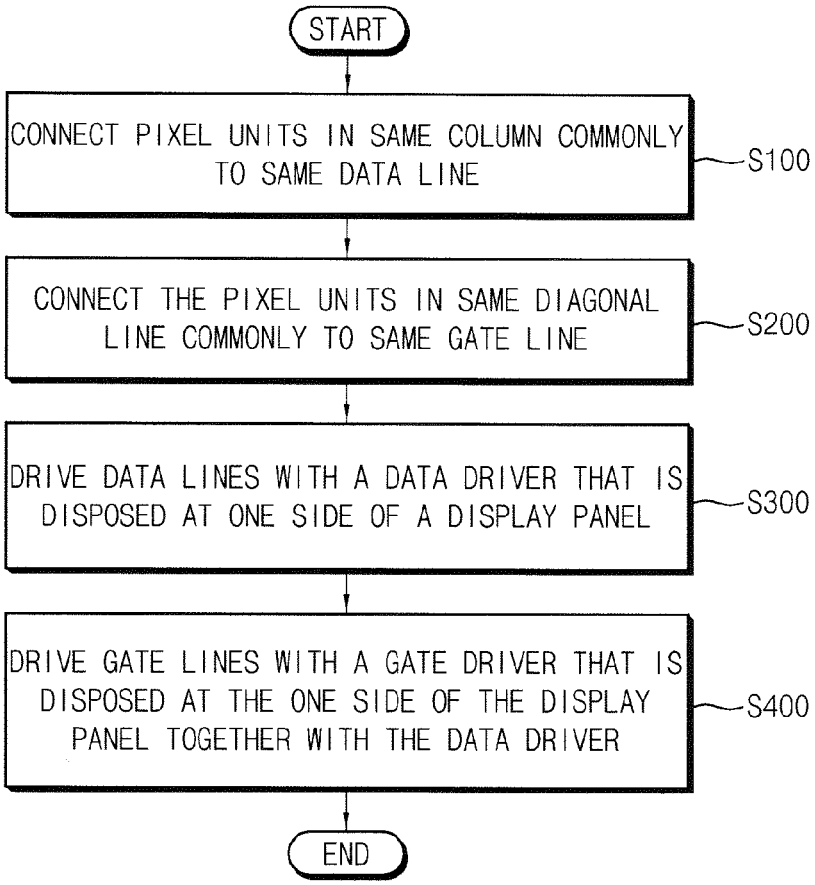
FIG. 1 is a flowchart illustrating a method of sing-side driving for an electroluminescent display according to example embodiments.

New structures and new digital driving schemes are being investigated to reduce the bezel width in electroluminescent displays, but there are challenges such as increasing the data rate. In digital driving methods, the quality of a displayed image can degrade due to a deviation of threshold voltages of transistors included in pixels, lack of charging time, etc.

The example embodiments are described more fully hereinafter with reference to the accompanying drawings. Like or similar reference numerals refer to like or similar elements throughout. In this disclosure, the term "substantially" includes the meanings of completely, almost completely or to any significant degree under some applications and in accordance with those skilled in the art. Moreover, "formed on" can also mean "formed over." The term "connected" can include an electrical connection.

FIG. 1 illustrates a single-sided driving method for an electroluminescent display including a display panel where the display panel includes a plurality of pixel units connected to a plurality of data lines and a plurality of gate lines, and the pixel units are arranged in a matrix form of a plurality of rows and a plurality of columns. In some embodiments, the FIG. 1 procedure is implemented in a conventional programming language, such as C or C++ or another suitable programming language. The program can be stored on a computer accessible storage medium of the display device 100, for example, a memory (not shown) of the display device 100 or the timing controller 150. In certain embodiments, the storage medium includes a random access memory (RAM), hard disks, floppy disks, digital video devices, compact discs, video discs, and/or other optical storage mediums, etc. The program can be stored in the processor. The processor can have a configuration based on, for example, i) an advanced RISC machine (ARM) microcontroller and ii) Intel Corporation's microprocessors (e.g., the Pentium family microprocessors). In certain embodiments, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 8/7/Vista/2000/9x/ME/XP, Macintosh OS, OS X, OS/2, Android, iOS and the like. In another embodiment, at least part of the procedure can be implemented with embedded software. Depending on the embodiment, additional states can be added, others removed, or the order of the states changed in FIG. 1.

Referring to FIG. 1, the pixel units in the same column are connected commonly to the same data line (S100). In addition, the pixel units in the same diagonal line are connected commonly to the same gate line (S200). For example, the pixel units are arranged in the matrix form of the m rows and the n columns where m is a positive integer and n is a positive integer greater than m. In this case, the pixel units in the (i)-th row and in the (j)-th column can be connected commonly to the (i+j−1)-th gate line where i is a positive integer equal to or less than m and j is a positive integer equal to or less than n. An example configuration of the pixel unit and an example connection between the pixel units and the data/gate lines are described below with reference to FIGS. 3 and 4.

The data lines are driven using a data driver formed at one side of the display panel (S300). In addition, the gate lines are driven using a gate driver formed at the one side of the display panel together with the data driver (S400). The bezel width can be reduced by forming the data driver and the gate driver together at the same side of the display panel.

Figure 2:
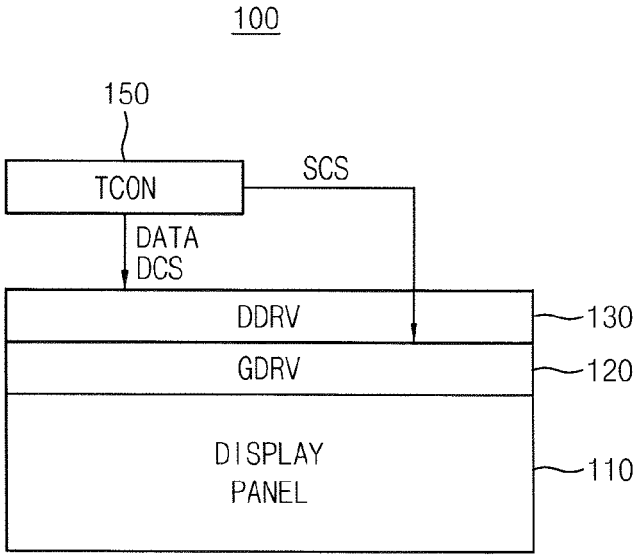
FIG. 2 is a block diagram illustrating an electroluminescent display having a single-side driving structure according to example embodiments.

FIG. 2 is a block diagram illustrating an electroluminescent display having a single-side driving structure according to example embodiments. Depending on embodiments, certain elements may be removed from or additional elements may be added to the display device 100 illustrated in FIG. 1. Furthermore, two or more elements may be combined into a single element, or a single element may be realized as multiple elements. This applies to the remaining apparatus embodiments.

The display device 100 or a display module illustrated in FIG. 2 can be an electroluminescent display including a light-emitting diode (LED) or an organic light-emitting diode (OLED) that emits light through the recombination of electrons and holes.

Referring to FIG. 2, the display device 100 includes a display panel 110 including a plurality of pixel units PX, a gate driver GDRV 120, a data driver DDRV 130 and a timing controller TMC 150. Even though not illustrated in FIG. 2, the display device 100 can further include a voltage providing circuit for providing power and voltage signals, a buffer memory for storing image data temporarily, etc.

As will described below with reference to FIG. 3, pixel units included in the display panel 110 can be arranged in a matrix form of a plurality of rows 1~m and a plurality of columns 1~n and can be connected to a plurality of data lines D1~Dn and a plurality of gate lines G1~Gm+n−1. Each pixel unit can include a plurality of sub pixels. For example, as will be described below with reference to FIG. 4, each pixel unit includes a red sub pixel R, a green sub pixel G and a blue sub pixel B, which are arranged in a row direction. In this case, each of the data lines in FIG. 3 can include three signal lines for driving the three RGB sub pixels.

The data driver 130 can be formed at one side of the display panel 110 to drive the data lines D1~Dn. In addition, the gate driver 120 can be formed at the one side of the display panel 110 together with the data driver 130, to drive the gate lines G1~Gm+n−1. In some embodiments, the data driver 130 and the gate driver 120 are formed at the top side of the display panel 100 together as illustrated in FIG. 2. The data driver 130 can provide data signal to the pixels by units of columns through the data lines D1~Dn. The gate driver 120 can prove gate signals to the pixels by units of diagonal lines through the gate lines G1~Gm+n−1.

The timing controller 150 can receive and convert image signals from an external device and provide converted image data to the data driver 130. Also the timing controller 150 can receive a vertical synchronization signal, a horizontal synchronization signal, and a clock signal from the external device and generate control signals for the gate driver 120 and the data driver 130. The timing controller 150 can provide scan driving control signals SCS to the scan driver 120 and data driving control signals DCS to the data driver 130, respectively. In some embodiments, the gate driver 120 and the data driver 130 are integrated together with the display panel 110. In some embodiments, the gate driver 120 and the data driver 130 are integrated as a chip independently from the display panel 110.

As such, the bezel width or the bezel area can be reduced and a display device of a three-side-no-bezel structure can be implemented by forming the gate driver 120 and the data driver 130 at the same side of the display panel 110.

Figure 3:
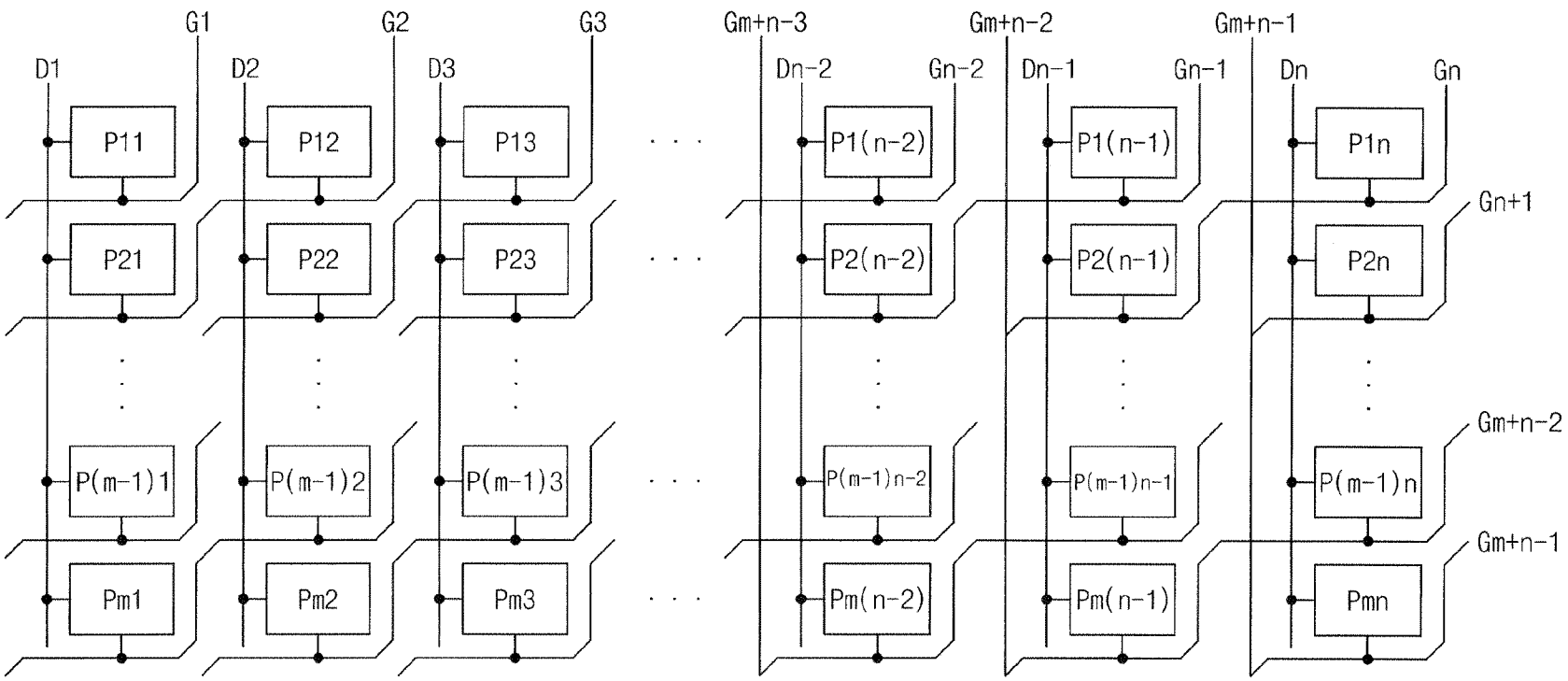
FIG. 3 is a diagram illustrating an example embodiment of a display panel included in the electroluminescent display of FIG. 2.
Figure 4:
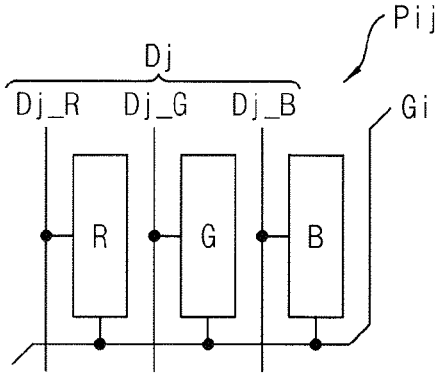
FIG. 4 is a diagram illustrating an example embodiment of a pixel unit included in the display panel of FIG. 3.

FIG. 3 is a diagram illustrating an example embodiment of a display panel included in the electroluminescent display of FIG. 2. FIG. 4 is a diagram illustrating an example embodiment of a pixel unit included in the display panel of FIG. 3.

Referring to FIG. 3, the display panel 110 includes pixel units P11~Pmn that are arranged in a matrix form of m rows and n columns where m is a positive integer and n is a positive integer greater than m.

The m pixel units P1*j*~Pmj in the (j)-th column can be connected commonly to the (j)-th data line Dj where j is a positive integer equal to or less than n. The m pixel units P11~Pm1 in the first column can be connected commonly to the first data line D1, the m pixel units P12~Pm2 in the second column can be connected commonly to the second data line D2, and likewise the m pixel units P1*n*~Pmn in the last column, that is, the (n)-th column, can be connected commonly to the (n)-th data line Dn.

The pixel units in the (i)-th row and in the (j)-th column can be connected commonly to the (i+j−1)-th gate line where i is a positive integer equal to or less than m.

With respect to a left-top portion of the display panel 110, the number of the pixel units connected commonly to one gate line can be increased one by one. The one pixel unit P11 can be connected commonly to the first gate line G1, the two pixel units P21 and P12 can be connected commonly to the second gate line G2 and the three pixel units P31, P22 and P13 can be connected commonly to the third gate line G3. As such, the m−1 pixel units P(m−1)1~P1(*m*−1) can be connected commonly to the (m−1)-th gate line Gm−1 and the m pixel units Pm1~P1*m* can be connected commonly to the (m)-th gate line Gm.

With respect to a center portion of the display panel 110, the number of the pixel units connected commonly to one gate line can be maintained. As illustrated in FIG. 3, the m pixel units are connected commonly to each of the (m+1)-th gate line Gm+1 through (n)-th gate line Gn.

With respect to a right-bottom portion of the display panel 110, the number of the pixel units connected commonly to one gate line can be decreased one by one. The m−1 pixel units Pm(n−m+2)~P2*n* can be connected commonly to the (n+1)-th gate line Gn+1, and the m−2 pixel units Pm(n−m+3)~P3*n* can be connected commonly to the (n+2)-th gate line Gn+2. As such, the three pixel units Pm(n−2), P(m−1)(n−1) and P(m−2)n can be connected commonly to the (m+n−3)-th gate line Gm+n−3, the two pixel units Pm(n−1) and P(m−1)n can be connected commonly to the (m+n−2)-th gate line Gm+n−2 and the one pixel unit Pmn can be connected to the last gate line Gm+n−1.

Each of the first gate line G1 through (n)-th gate line Gn can include a diagonal gate line that is extended in a diagonal direction. The gate driver 120 can be formed at the top side of the display panel 110 as illustrated in FIG. 2 and the diagonal lines of the first gate line G1 through (n)-th gate line Gn can be connected to the gate driver 110 at the top side of the display panel 110.

Each of the (n+1)-th gate line Gn+1 and the (m+n−1)-th gate line Gm+n−1 can include a vertical gate line that is connected to the gate driver 110 at the top side of the display panel 110 and extended in a column direction and a diagonal line that is connected to the vertical gate line at a bottom side of the display panel 110 and extended in the diagonal direction.

FIG. 4 illustrates an example of the pixel unit Pij that is connected to the (i)-th gate line Gi and the (j)-th data line Dj. Referring to FIG. 4, each data line Dj includes a red data line Dj_R, a green data line Dj_G and a blue data line Dj_B. Each pixel unit Pij can include a red sub pixel R connected to the red data line Dj_R, a green sub pixel G connected to the green data line Dj_G and a blue sub pixel B connected to the blue data line Dj_B. The red sub pixel R, the green sub pixel G and the blue sub pixel B in the same unit pixel Pij can be connected commonly to the same gate line Gi.

Figure 5:
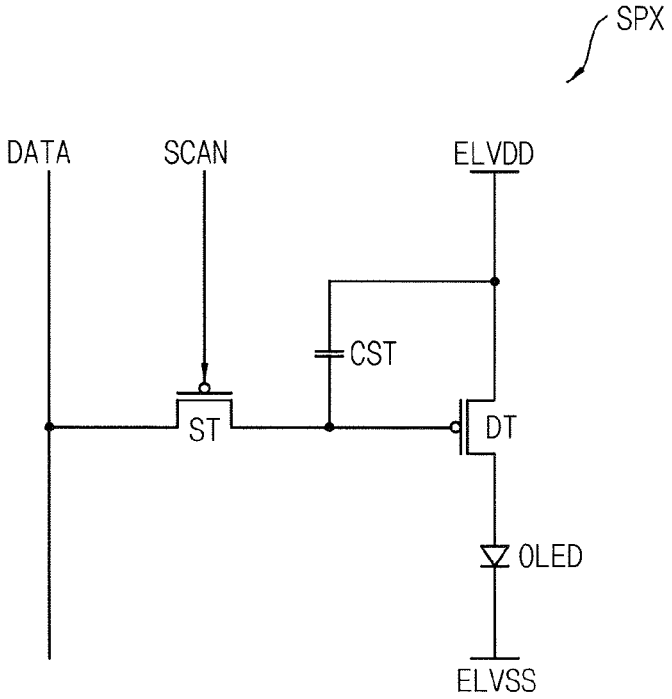
FIG. 5 is a circuit diagram illustrating a sub pixel included in the pixel unit of FIG. 4.

FIG. 5 is a circuit diagram illustrating a sub pixel included in the pixel unit of FIG. 4.

Referring to FIG. 5, each sub pixel SPX includes a switching transistor ST, a storage capacitor CST, a driving transistor DT, and an OLED. Each of the red sub pixel R, the green sub pixel G and the green sub pixel B can have the configuration as illustrated in FIG. 5.

The switching transistor ST has a first source/drain terminal connected to a data line, a second source/drain terminal connected to the storage capacitor CST, and a gate terminal connected to the scan line. The switching transistor ST transfers a data signal DATA received from the data driver to the storage capacitor CST in response to a scan signal SCAN received from the gate driver.

The storage capacitor CST has a first electrode connected to a high power supply voltage ELVDD and a second electrode connected to a gate terminal of the driving transistor DT. The storage capacitor CST stores the data signal DATA transferred through the switching transistor ST.

The driving transistor DT has a first source/drain terminal connected to the high power supply voltage ELVDD, a second source/drain terminal connected to the OLED, and the gate terminal connected to the storage capacitor CST. The driving transistor DT is turned on or off according to the data signal DATA stored in the storage capacitor CST.

The OLED has an anode electrode connected to the driving transistor DT and a cathode electrode connected to a low power supply voltage ELVSS. The OLED emits light based on a current flowing from the high power supply voltage ELVDD to the low power supply voltage ELVSS while the driving transistor DT is turned on.

This structure of each sub pixel PX, or a 2T1C structure including two transistors ST and DT and one capacitor CST is one example of a pixel structure that is suitable for single-side driving due to the simplified control signals of the sub pixel SPX.

Figure 6:
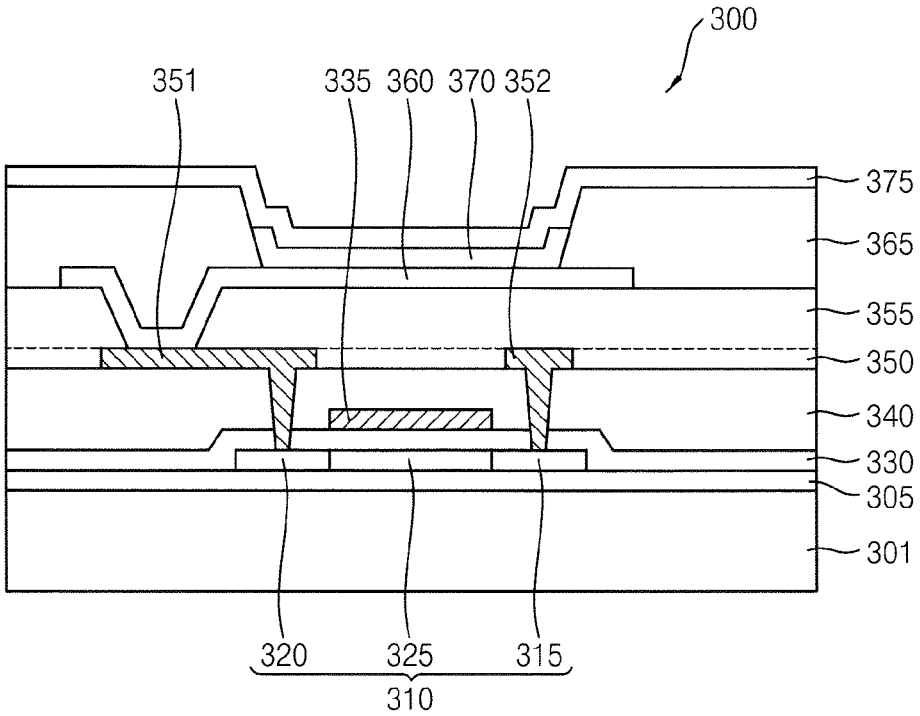
FIG. 6 is a cross-sectional view for describing a vertical structure of the sub pixel of FIG. 5.

FIG. 6 is a cross-sectional view for describing a vertical structure of the sub pixel of FIG. 5.

FIG. 6 illustrates only the driving transistor DT and the OLED among the elements in the sub pixel SPX of FIG. 5. Referring to FIG. 6, the display panel 300 includes a substrate 301, a buffer layer 305, an active pattern 310, a gate insulation layer 330, a sixth gate electrode 335, a first insulation interlayer 340, connection patterns 351 and 352 formed in the metal layer 350, a second insulation interlayer 355, an anode electrode 360, a pixel definition layer 365, an organic light-emitting layer 370, and a cathode electrode 375.

The buffer layer 305 is formed on the substrate 301 and the active pattern 310 can be formed on the buffer layer 305, where the substrate 301 can be formed of an insulation material such as glass, transparent plastic, ceramic, etc. The active pattern 310 can be formed by a sputtering process, a CVD process, a printing process, a spray process, a vacuum deposition process, an ALD process, a sol-gel process, PECVD process, etc. The active pattern 310 can include source and drain regions 315 and 320 and channel region 325 located below the gate electrode 335.

The gate insulation layer 330 can be formed to cover the active pattern 310. The gate insulation layer 330 can be formed by a CVD process, a thermal oxidation process, a plasma enhanced chemical vapor deposition (PECVD) process, a high density plasma-chemical vapor deposition (HDP-CVD) process, etc. The gate insulation layer 330 can be a relatively thick to sufficiently cover the active pattern 310.

The gate electrode 335 can be formed on the gate insulation layer 330. The gate electrode 335 can be formed by a sputtering process, a CVD process, a printing process, a spray process, a vacuum deposition process, an ALD process, etc.

The active pattern 310 can be doped by the impurity after the gate electrode 335 is formed. The source and drain regions 315 and 320 can be doped by the impurity, and the channel region 325 located below the gate electrode 335 can be not doped. As a result, the source and drain regions 315 and 320 can act as the conductor and the channel region 325 can act as the channel of the driving transistor DT.

The first insulation interlayer 340 can be formed on the gate insulation layer 330 to cover the gate electrode 335. The first insulation interlayer 340 can be a relatively thick to sufficiently cover the sixth gate electrode 335. The first insulation interlayer 340 can have a substantially flat upper surface. In some embodiments, a planarization process is performed on the first insulation interlayer 340 to enhance the flatness of the first insulation interlayer 340.

The first insulation interlayer 340 can be partially etched to form contact holes partially exposing the source and drain regions 315 and 320 of the active pattern 310. The connection patterns 351 and 352 can be formed in the metal layer 350 by filling the contact holes.

The second insulation interlayer 355 can be formed on the first insulation interlayer 340 to cover the connection patterns 351 and 352. The second insulation interlayer 355 can be relatively thick to sufficiently cover the connection patterns 351 and 352. The second insulation interlayer 355 can have a substantially flat upper surface. In some embodiments, a planarization process is performed on the second insulation interlayer 355 to enhance the flatness of the second insulation interlayer 355.

The second insulation interlayer 355 can be partially etched to form a contact hole partially exposing a portion of the connection pattern 351. The anode electrode 360 can be formed on the second insulation interlayer 355 by filling the contact hole.

The pixel definition layer 365 can be formed on the second insulation interlayer 355 to cover the anode electrode 360. The pixel definition layer 365 can be a relatively thick to sufficiently cover the anode electrode 360.

The pixel definition layer 365 can be partially etched to form an opening that exposes the anode electrode 360. The organic light emitting layer 370 can be formed in the opening. The organic light emitting layer 370 can be formed on the anode electrode 360 exposed by the opening.

The cathode electrode 375 can be formed on the pixel definition layer 365 and organic light emitting layer 370. The cathode electrode is formed as a whole to cover the entire active region in which the pixel units are formed.

The structure of the sub pixel described with reference to FIGS. 5 and 6 is a non-limiting example and the structure of the sub pixel can be changed variously.

Figure 7A:
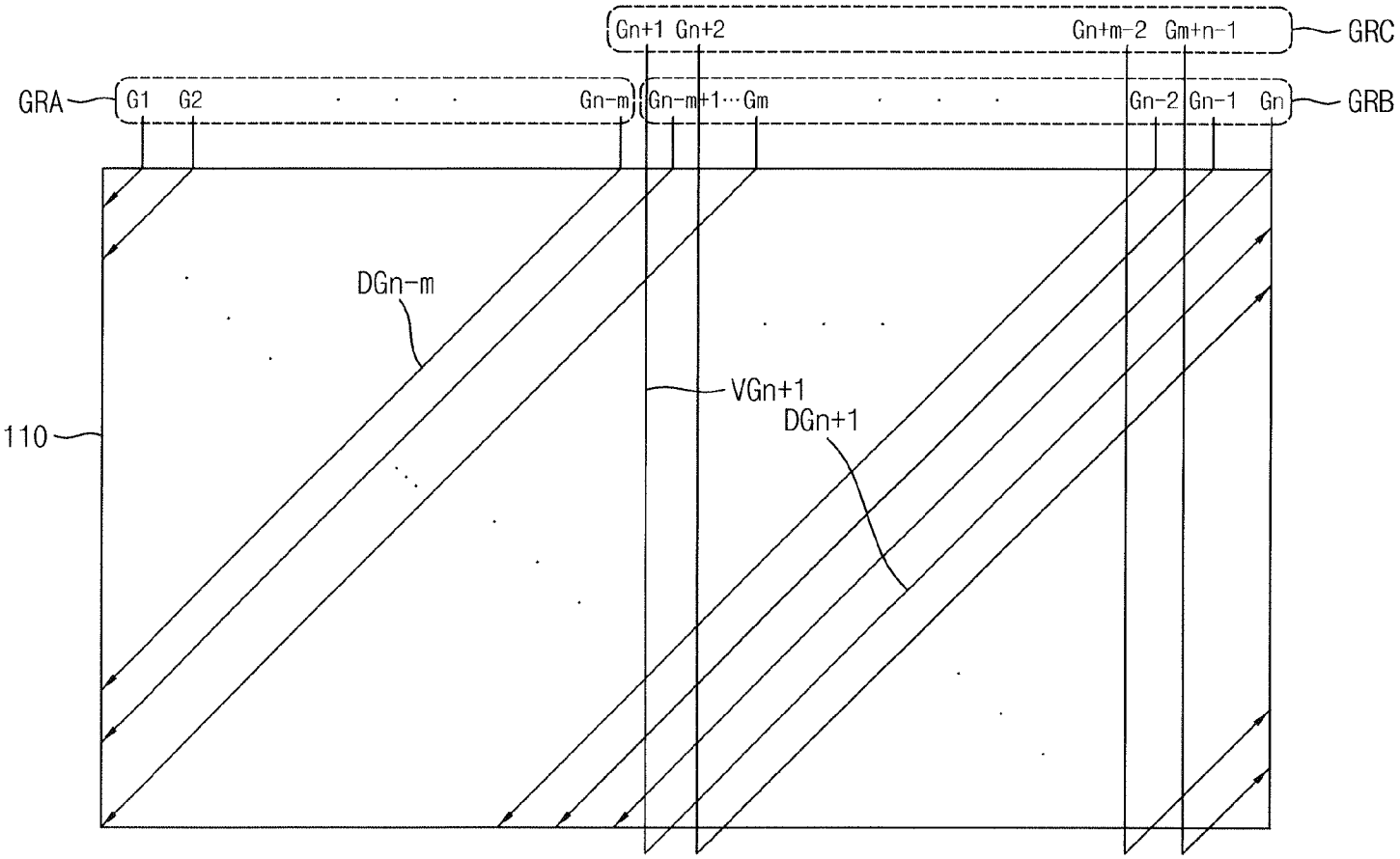
FIGS. 7A and 7B are diagrams for describing an example of grouping gate lines and pixel units according to example embodiments.
Figure 7B:
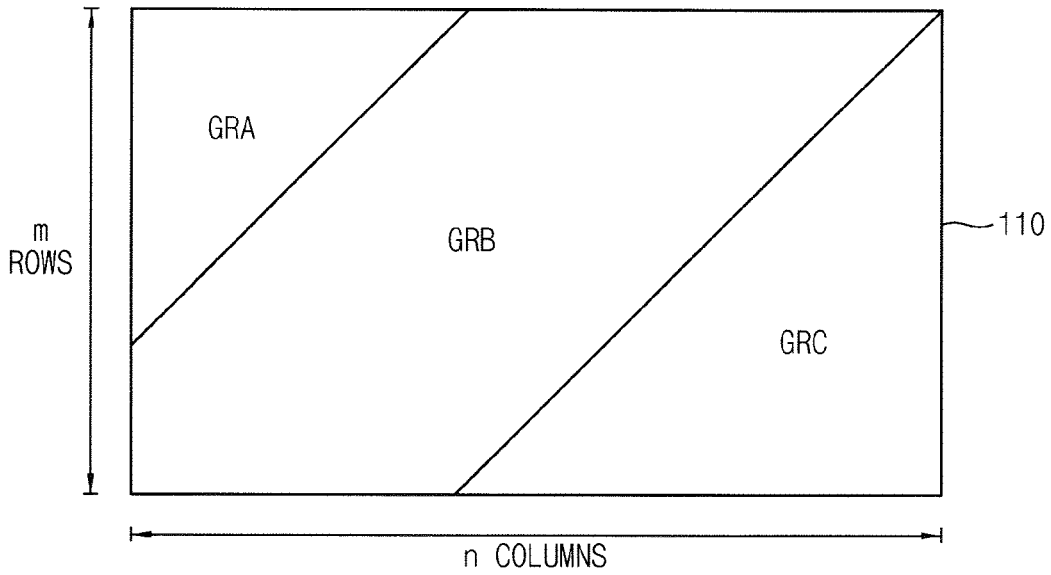

FIGS. 7A and 7B are diagrams for describing an example of grouping gate lines and pixel units according to example embodiments.

Referring to FIG. 7A, each of the first gate line G1 through (n)-th gate line Gn includes a diagonal gate line that is extended in a diagonal direction. For example the (n−m)-th gate line Gn−m includes the one diagonal gate line DGn−m that is extended in the diagonal direction. The gate driver 120 is formed at the top side of the display panel 110 as illustrated in FIG. 2 and the diagonal line is connected to the gate driver 120 at the top side of the display panel 110.

Each of the (n+1)-th gate line Gn+1 through the (m+n−1)-th gate line Gm+n−1 includes a vertical gate line that is connected to the gate driver 120 at the top side of the display panel 110 and extended in a column direction and a diagonal line that is connected to the vertical gate line at a bottom side of the display panel 110 and extended in the diagonal direction. For example, the (n+1)-th gate line Gn+1 includes the one vertical gate line VGn+1 and the one diagonal gate line DGn+1. The pixel units are connected to the diagonal gate lines as described with reference to FIG. 3, and the vertical gate lines are formed to connect the diagonal gate lines to the gate driver 120 formed at the top side of the display panel 110.

The first gate line through the (m+n−1)-th gate line are grouped into a first group GRA, a second group GRB and a third group GRC. The first group GRA includes the first gate G1 line through the (n−m)-th gate line Gn−m, the second group GRB includes the (n−m+1)-th gate line Gn−m+1 through the (n)-th gate line Gn and the third group GRC includes the (n+1)-th gate line Gn+1 through the (n+m−1)-th gate line Gn+m−1. According to grouping of the gate lines, the pixel units in the display panel 110 can be grouped into the first group GRA, the second group GRB and the third group GRC as illustrated in FIG. 7B. As such, in some embodiments, the gate lines and the pixel units are grouped so that the one data line do not overlap even though the two or three gate lines of the different groups are activated simultaneously or concurrently in the same period. The data rate can be reduced and the charging time can be secured by activating the multiple gate lines simultaneously.

Figure 8:
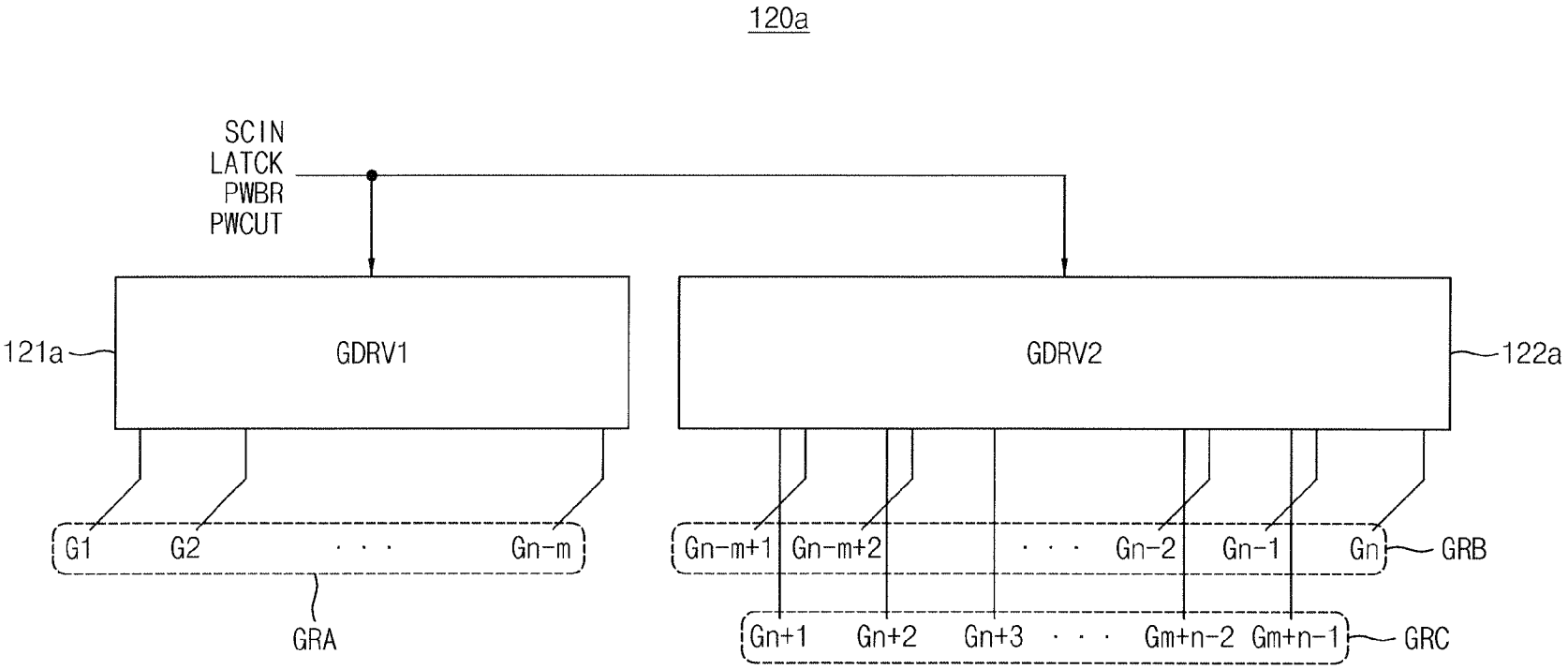
FIG. 8 is a block diagram illustrating an example embodiment of a gate driver included in the electroluminescent display of FIG. 2.

FIG. 8 is a block diagram illustrating an example embodiment of a gate driver included in the electroluminescent display of FIG. 2.

Referring to FIG. 8, the gate driver 120*a* includes a first gate driver GDRV1 121*a* and a second gate driver GDRV2 122*a*. The first gate driver 121*a* can drive the first gate line G1 through the (n−m)-th gate line Gn−m of the first group GRA. The second gate driver 122*a* can drive the (n−m+1)-th gate line Gn−m+1 through the (m+n−1)-th gate line Gm+n−1 of the second and third groups GRB and GRC. As described above, the diagonal gate lines extended in the diagonal direction can be connected to the first and second gate drivers 121*a* and 122*a* respectively in case of the first gate line G1 through the (n)-th gate line Gn, and the vertical gate lines extended in the column direction can be connected to the second gate driver 122*a* in case of the (n+1)-th gate line Gn+1 through the (m+n−1)-th gate line Gm+n−1.

The first and second gate drivers 121*a* and 122*a* can commonly receive the scan driving control signal SCS that is illustrated in FIG. 2. The scan driving control signal SCS can include a scan address signal SCIN, a latch clock signal LATCK, a pulse width broadening signal PWBR, a pulse width cut signal PWCUT, etc. The scan address signal SCIN can represent the number of the gate lines to be activated and the scan address signal SCIN can include a plurality of bits according to the number of gate lines. The latch clock signal LATCK can represent the activation timing of the gate signal or the scan signal applied to the gate line and the pulse width cut signal PWCUT can represent the deactivation timing of the gate signal. The pulse width broadening signal PWBR can represent whether to activate multiple gate lines simultaneously.

The first and second gate drivers 121*a* and 122*a* can commonly receive the scan address signal SCIN and the latch clock signal LATCK to drive and activate one gate line of the first, second and third groups GRA, GRB and GRC for each scan period as will be described with reference to FIGS. 9, 10 and 11.

Figure 9:
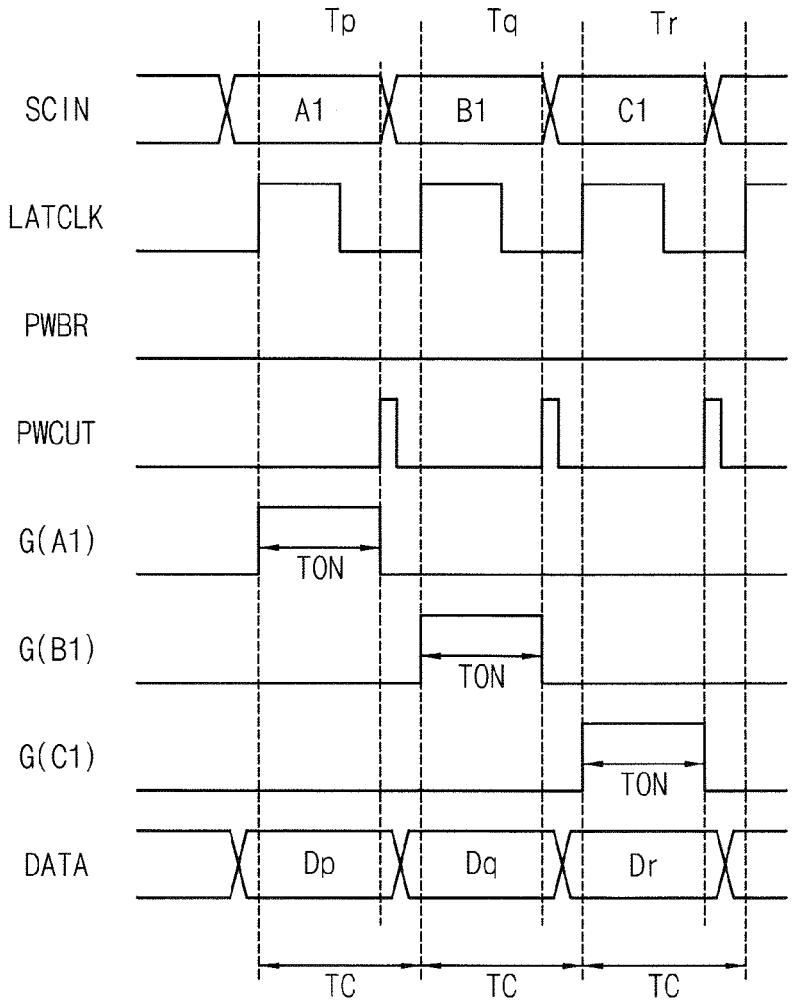
Figure 10:
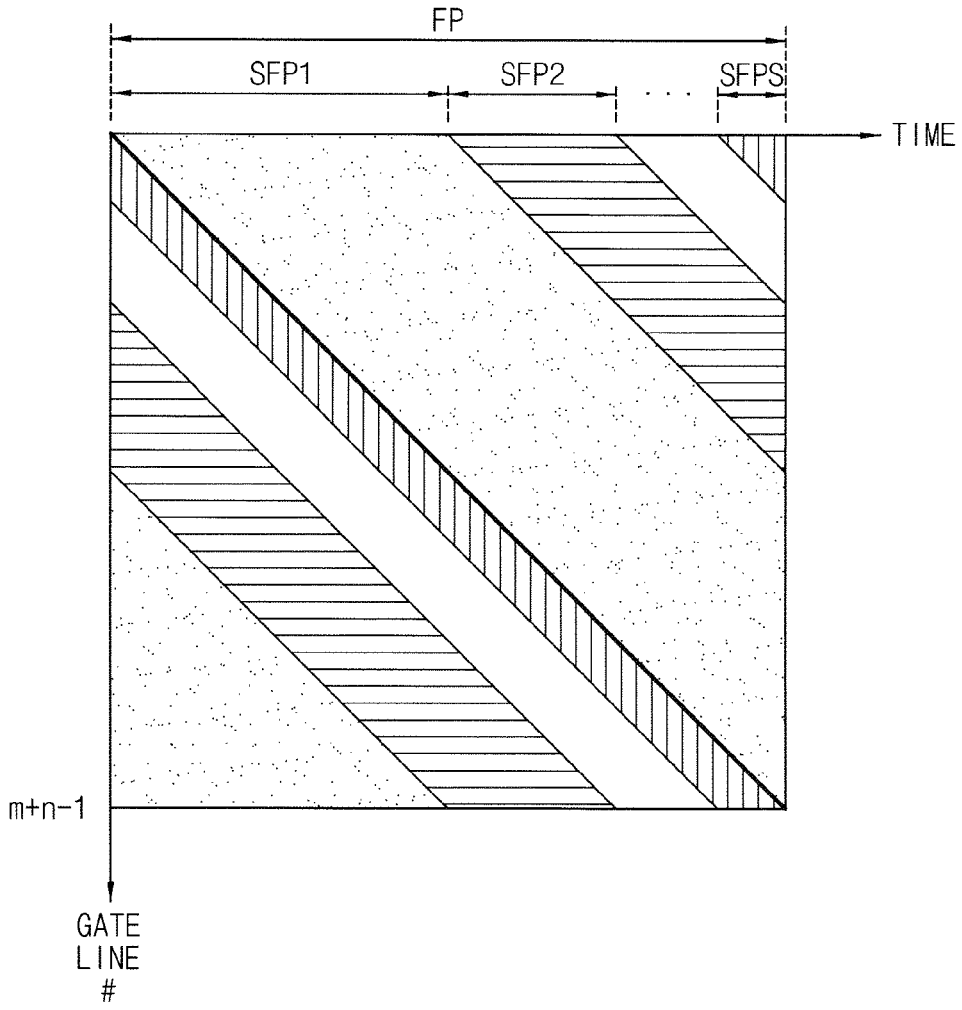

FIGS. 9, 10 and 11 are diagrams illustrating a method of single-sided driving using the gate driver of FIG. 8 according to example embodiments.

FIG. 9 illustrates the scan driving control signals SCIN, LATCK, PWBR and PWCUT, gate signals G(A1), G(B1) and G(C1) and data Dp, Dq and Dr with respect to a first scan period Tp, a second scan period Tq and a third scan period Tr. In some embodiments, the first, second and third scan periods Tp, Tq and Tr are not consecutive periods and the other scan periods exist between the first and second scan periods Tp and Tq and/or between the second and third scan periods Tq and Tr.

In FIG. 9, A1 represents the number of the gate line in the first group GRA, B1 represents the number of the gate line in the second group GRB, and C1 represents the number of the gate line in the third group C1. G(A1) represents the gate signal applied to the A1 gate line in the first group GRA, G(B1) represents the gate signal applied to the B1 gate line in the second group GRB, and G(C1) represents the gate signal applied to the C1 gate line in the third group GRA.

The gate driver 120*a* of FIG. 8 drives and activates one gate line of the first, second and third groups GRA, GRB and GRB for each scan period as illustrated in FIG. 9. For example, the gate driver 120*a* drives and activates one gate line among the first gate line G1 through the (m+n−1)-th gate line Gm+n−1. The pulse width broadening signal PWBR is deactivated in the logic low level and thus one gate line can be activated at each time. The activation time TON of the gate lines can be equal regardless of the groups GRA, GRB and GRC. For example, the activation time TON of the first gate line G1 through the (m+n−1)-th gate line Gm+n−1 are equal to each other.

For example, in case of the full high definition (FHD), the number m of the rows is 1080, the number n of the columns is 1920 and the number m+n−1 of the gate lines is 2999. If the frame rate is 75 Hz, the number of sub frames for digital driving is 8 and the progressive scan with simultaneous scan (PESS) scheme is applied, the time TC of the one scan period corresponds to about 0.5557 μs (microsecond). If the duty ratio of the gate signal is about 90%, the activation time TON of the gate lines is about 0.5001 μs. Here, the activation time corresponds to a turn-on time of the switching transistor ST in the sub pixel SPX of FIG. 5, that is, the charging time for storing the data signal DATA in the storage capacitor CST.

Referring to FIG. 10, one frame period FP includes S sub frame periods SFP1~SFPS. The sub frame periods SFP1~SFPS can have different emission times and the grayscale of the display data can be represented through the different emission times. The first and second gate drivers 121*a* and 122*b* in FIG. 8 commonly receive the scan address signal SCIN and thus the first and second gate drivers 121*a* and 122*b* can drive and activate one gate line among the gate lines G1~Gm+n−1. Thus the first and second gate drivers 121*a* and 122*a* can drive the gate lines of the first, second and third groups GRA, GRB and GRC in progressive emission with simultaneous scan (PESS) scheme.

FIG. 11 illustrates an example of the PESS scheme. As illustrated in FIG. 11, a time period corresponding to one frame period is divided into a plurality of unit times UNIT1, UNIT2, UNIT3, UNIT4, UNIT5, and UNIT6 according to the vertical resolution of the display panel 110. Thus, the number of unit times UNIT1, UNIT2, UNIT3, UNIT4, UNIT5, and UNIT6 corresponding to one frame period can be the number of scan lines in the display panel 110 or the number m of the pixel rows.

FIG. 11 illustrates an example that the display panel includes the six (m=6) pixel rows and the one frame period includes the four (S=4) sub frame periods. Accordingly, in FIG. 11, the time period corresponding to one frame period can be divided into 6 unit times UNIT1, UNIT2, UNIT3, UNIT4, UNIT5, and UNIT6. Each of the unit times UNIT1, UNIT2, UNIT3, UNIT4, UNIT5, and UNIT6 can be divided into 4 partial times. In this embodiment, data corresponding to different sub-frames is written to different pixel rows at the partial times of each unit time UNIT1, UNIT2, UNIT3, UNIT4, UNIT5, and UNIT6, respectively. Data corresponding to each sub-frame can be sequentially written to the 6 pixel rows while being delayed by one unit time with respect to the respective pixel rows. In this PESS scheme, since the respective data write times for all pixel rows are distributed throughout a time period corresponding to one frame period, each data write time can be sufficiently obtained. Accordingly, the PESS scheme can be suitable for large-sized display devices having high resolution.

Figure 12:
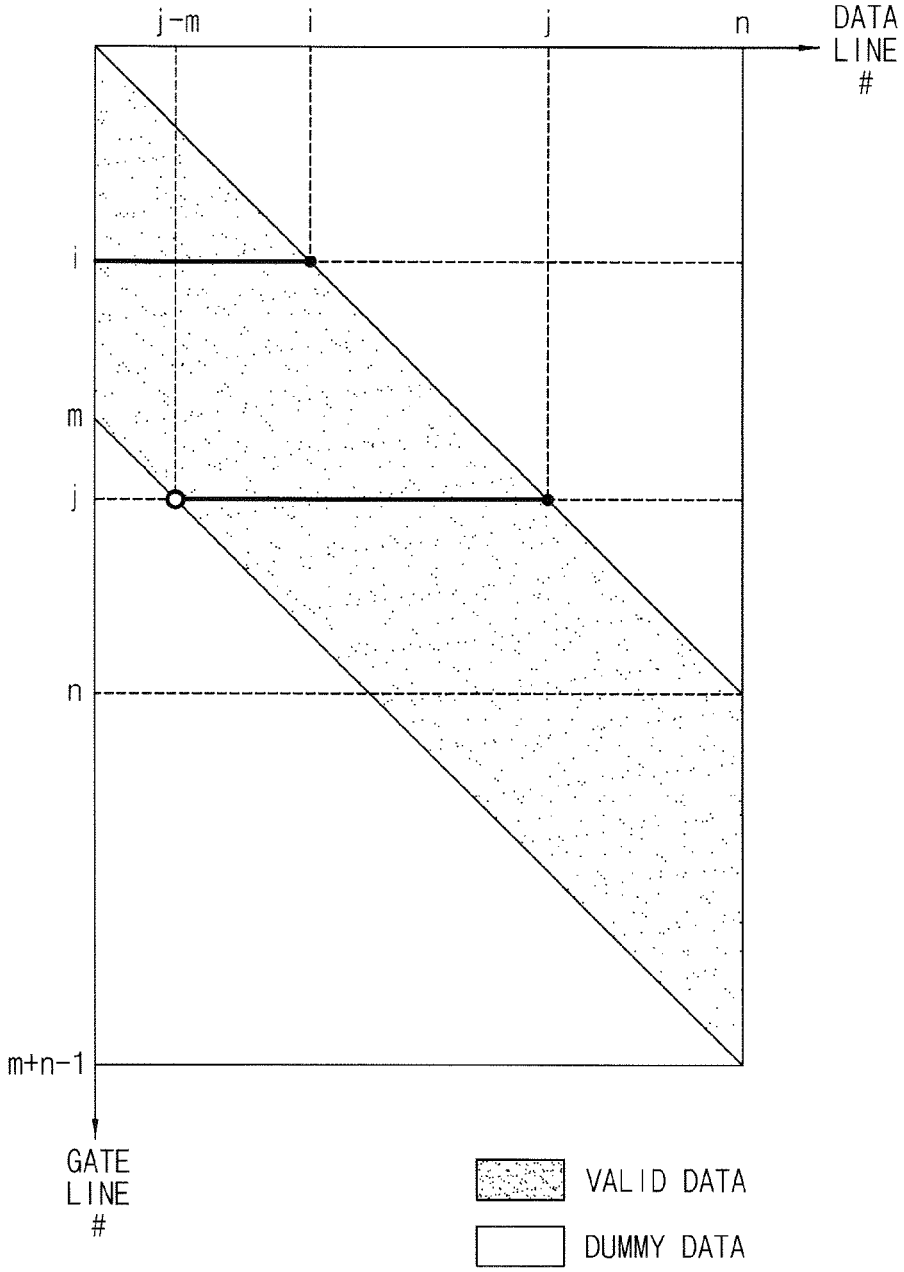
FIG. 12 is a diagram for describing an example of data application in a method of single-side driving according to example embodiments.

FIG. 12 is a diagram for describing an example of data application in a method of single-side driving according to example embodiments.

In FIG. 12, the horizontal axis represents the number of the data line and the vertical axis represents the number of the gate line. As described above, if the number of the rows of the pixel units is m and the number of the columns is n, the total number of the gate lines becomes m+n−1.

In case of the example embodiment described with reference to FIGS. 8, 9 and 10, one gate line is activated for each scan period. In this case, the valid data signals are applied to a portion of the data lines and the dummy data signals are applied to the other data lines for each scan period. In FIG. 12, the dotted region represents the application of the valid data and the other region represents the application of the dummy data.

For example, when the (i)-th gate line Gi (where i is a positive integer less than m) is selected and activated, the valid data are applied to the first through (i)-th data lines D1~Di and the dummy data are applied to the other gate lines Di+1~Dn. For another example, when the (j)-th gate line Gj (where j is a positive integer greater than m and less than n) is selected and activated, the valid data are applied to the (j−m+1)-th through (j)-th data lines Dj−m+1~Dj and the dummy data are applied to the other gate lines D1~Dj−m and Dj+1~Dn.

Figure 13:
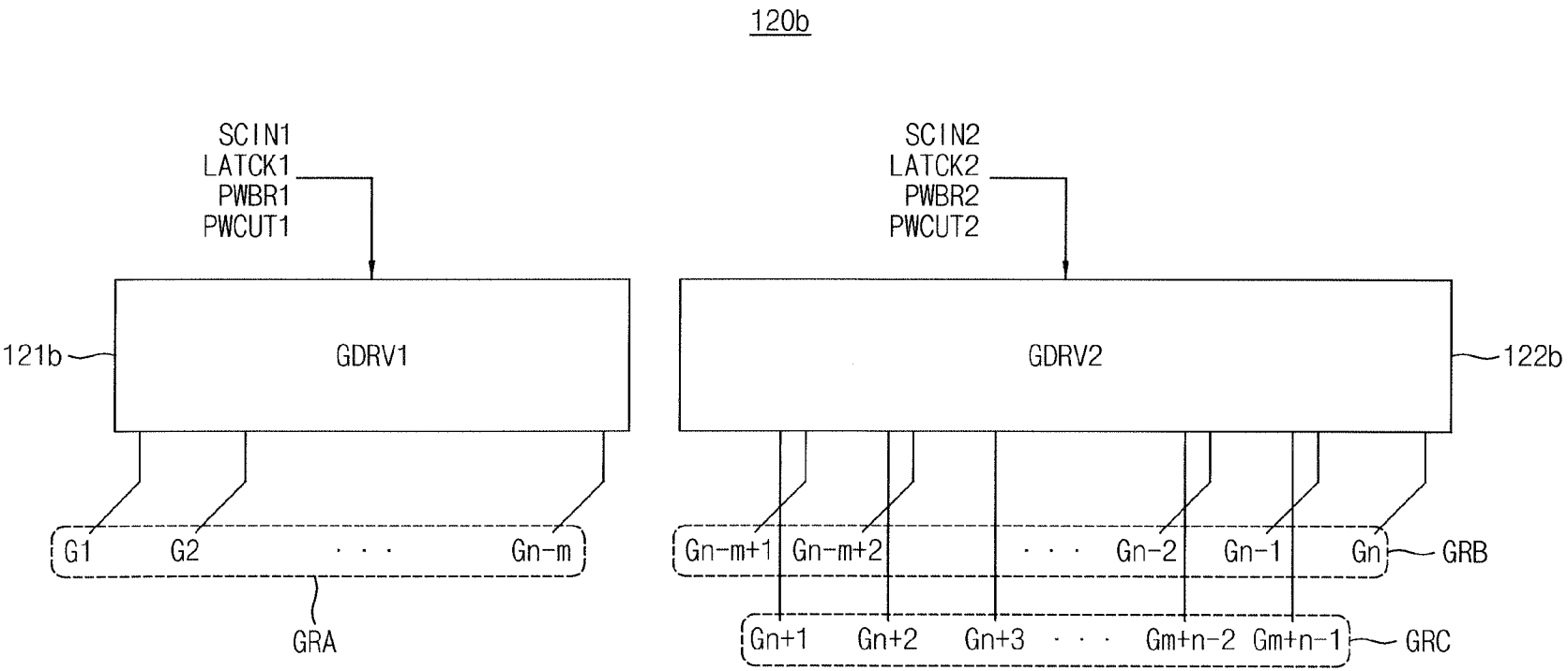
FIG. 13 is a block diagram illustrating an example embodiment of a gate driver included in the electroluminescent display of FIG. 2.

FIG. 13 is a block diagram illustrating an example embodiment of a gate driver included in the electroluminescent display device of FIG. 2.

Referring to FIG. 13, the gate driver 120*b* includes a first gate driver GDRV1 121*b* and a second gate driver GDRV2 122*b*. The first gate driver 121*b* can drive the first gate line G1 through the (n−m)-th gate line Gn−m of the first group GRA. The second gate driver 122*b* can drive the (n−m+1)-th gate line Gn−m+1 through the (m+n−1)-th gate line Gm+n−1 of the second and third groups GRB and GRC. As described above, the diagonal gate lines extended in the diagonal direction can be connected to the first and second gate drivers 121*b* and 122*b* respectively in case of the first gate line G1 through the (n)-th gate line Gn, and the vertical gate lines extended in the column direction can be connected to the second gate driver 122*b* in case of the (n+1)-th gate line Gn+1 through the (m+n−1)-th gate line Gm+n−1.

The first and second gate drivers 121*b* and 122*b* receive the respective scan driving control signal SCS that is illustrated in FIG. 2. The first gate driver 121*b* can receive a first scan address signal SCIN1, a first latch clock signal LATCK1, a first pulse width broadening signal PWBR1 and a first pulse width cut signal PWCUT1. The second gate driver 122*b* can receive a second scan address signal SCIN2, a second latch clock signal LATCK2, a second pulse width broadening signal PWBR2 and a second pulse width cut signal PWCUT2. The scan address signals SCIN1 and SCIN2 can represent the numbers of the gate lines to be activated and each of the scan address signals SCIN1 and SCIN2 can include a plurality of bits according to the number of gate lines. The latch clock signals LATCK1 and LATCK2 can represent the activation timing of the gate signals applied to the gate lines and the pulse width cut signals PWCUT1 and PWCUT2 can represent the deactivation timing of the gate signals. The pulse width broadening signals PWBR1 and PWBR2 can represent whether to activate multiple gate lines simultaneously or concurrently.

The first gate driver 121*b* can receive the first scan address signal SCIN1 and the first latch clock signal LATCK1 to drive and activate one gate line among the gate lines G1~Gn−m of the first group GRA for each scan period. The second gate driver 122*b* can receive the second scan address signal SCIN2 and the second latch clock signal LATCK2 to drive and activate one gate line among the gate lines Gn−m+1~Gn of the second group GRB and one gate line among the gate lines Gn+1~Gm+n−1 of the third group GRC for each scan period.

Figure 14:
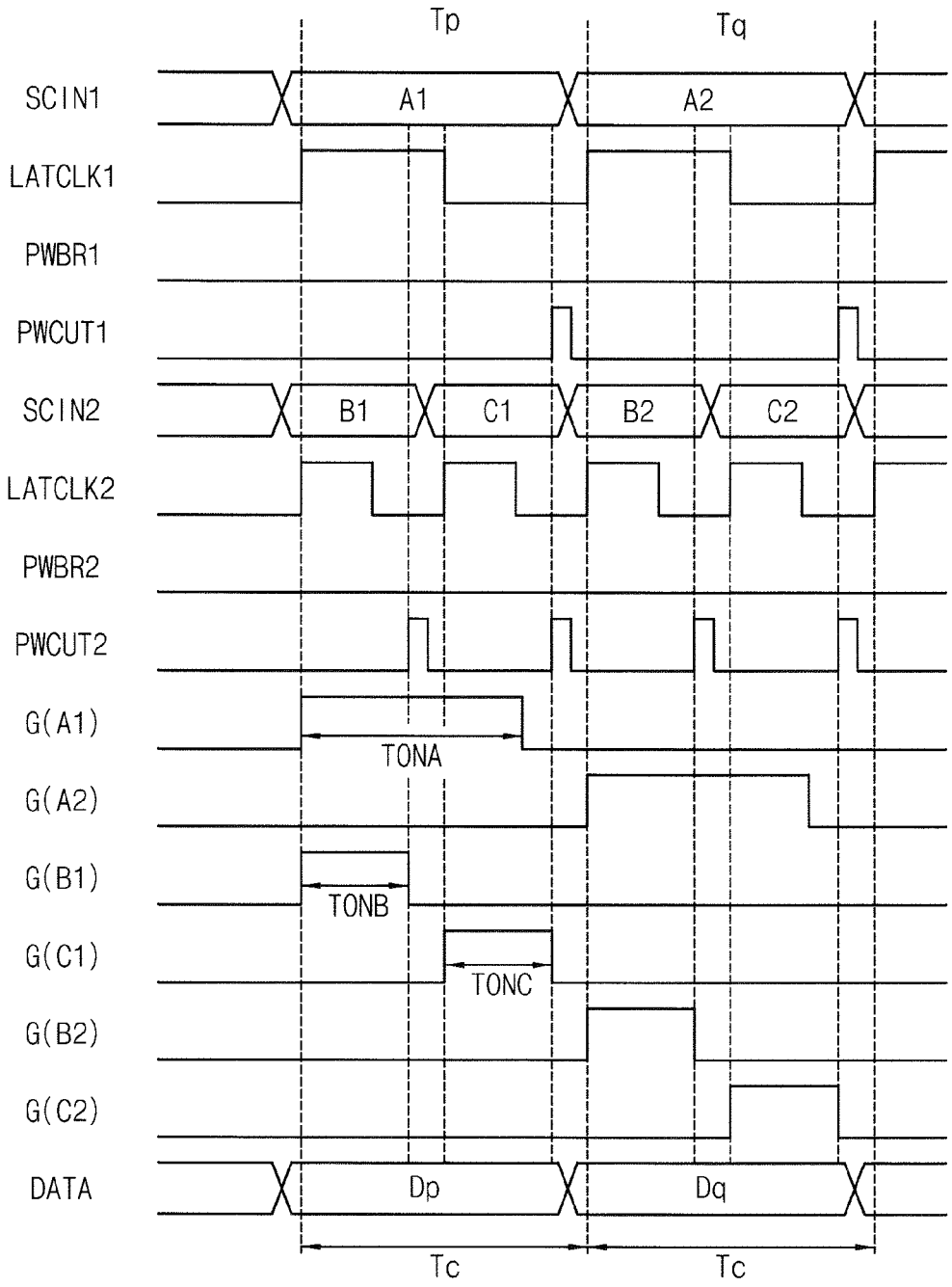
FIGS. 14 and 15 are diagrams illustrating a method of single-side driving using the gate driver of FIG. 13 according to example embodiments.
Figure 15:
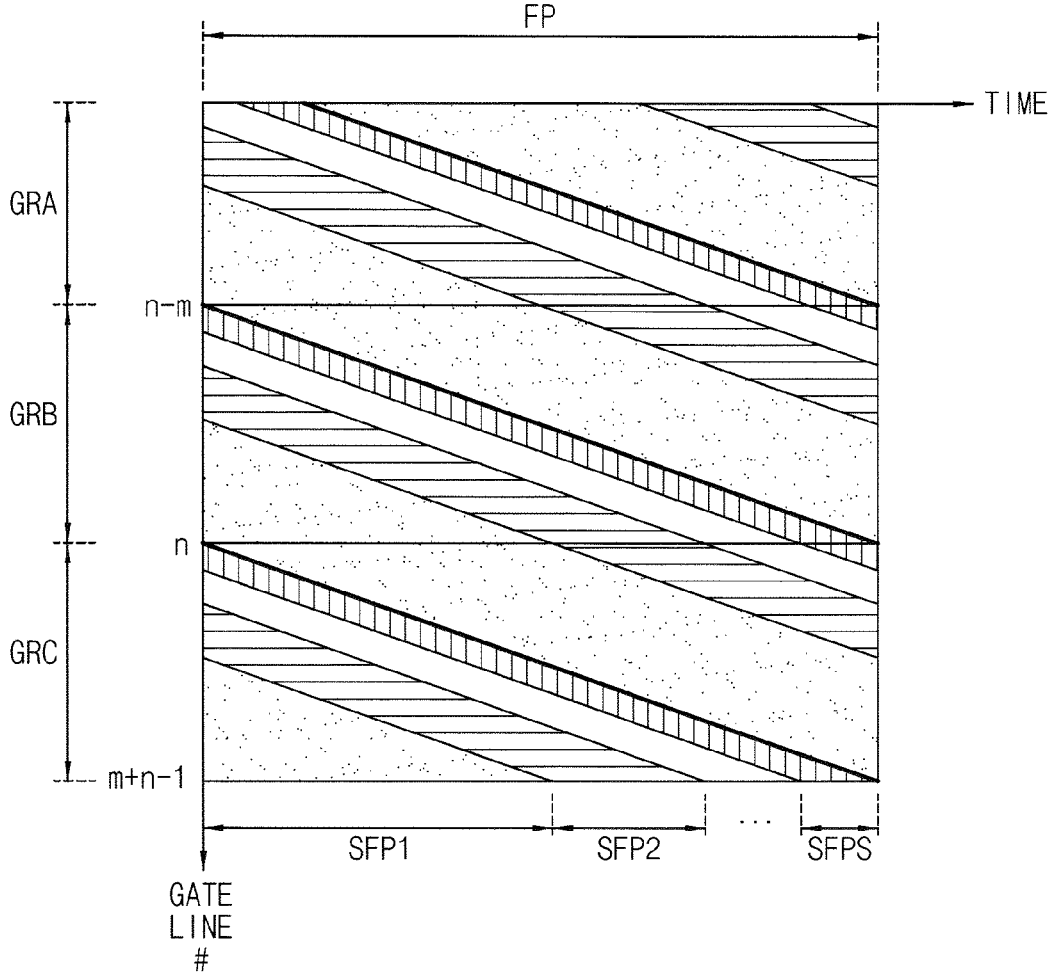

FIGS. 14 and 15 are diagrams illustrating a method of single-side driving using the gate driver of FIG. 13 according to example embodiments.

FIG. 14 illustrates the scan driving control signals SCIN1, SCIN2, LATCK1, LATCK2, PWBR1, PWBR2, PWCUT1 and PWCUT2, gate signals G(A1), G(A2), G(B1), G(B2), G(C1) and G(C2) and data Dp and Dq with respect to a first scan period Tp and a second scan period Tq. In some embodiments, the first and second scan periods Tp and Tq are not consecutive periods and the other scan periods exist between the first and second scan periods Tp and Tq.

In FIGS. 14, A1 and A2 represent the numbers of the gate lines in the first group GRA, B1 and B2 represent the numbers of the gate lines in the second group GRB, and C1 and C2 represent the numbers of the gate lines in the third group C1. G(A1) and G(A2) represent the gate signals applied to the A1 and A2 gate lines in the first group GRA, G(B1) and G(B2) represent the gate signals applied to the B1 and B2 gate lines in the second group GRB, and G(C1) and G(C2) represent the gate signals applied to the C1 and C2 gate lines in the third group GRA.

The first gate driver 121*b* in FIG. 13 can drive and activate one gate line among the gate lines G1~Gn−m of the first group GRA for each scan period as illustrated in FIG. 14. In addition, the second gate driver 122*b* in FIG. 13 can drive and activate one gate line among the gate lines Gn−m+1~Gn of the second group GRB and one gate line among the gate lines Gn+1~Gm+n−1 of the third group GRC for each scan period as illustrated in FIG. 14. The pulse width broadening signals PWBR1 and PWBR2 are deactivated in the logic low level and thus each of the first and second gate drivers 121*b* and 122*b* can activate one gate line at each time.

The second gate driver 122*b* can divide each scan period into a first half scan period and a second half scan period to drive and activate one gate line G(B1) or G(B2) of the second group GRB during the first half scan period and to drive and activate one gate line G(C1) or G(C2) of the third group GRC during the second half scan period.

The activation times TONB and TONC of the gate lines of the second and third groups GRB and GRC can be equal to each other, and the activation times TONB and TONC can be less than the activation time TONA of the gate lines of the first group GRA.

For example, in case of the full high definition (FHD), the number m of the rows is 1080, the number n of the columns is 1920 and the number m+n−1 of the gate lines is 2999. The number of the gate lines G1~Gn−m of the first group is 840, the number of the gate lines Gn−m+1~Gn is 1080 and the number of the gate lines Gn+1~Gm+n−1 is 1079. If the frame rate is about 75 Hz, the number of sub frames for digital driving is 8 and the PESS scheme as described with reference to FIG. 11 is applied, the time TC of the one scan period corresponds to about 1.5432 μs. If the duty ratio of the gate signal is about 90%, the activation time TONA of the gate lines of the first group GRA is about 1.3887 μs and the activation times TONB and TONC of the gate lines of the second and third groups GRB and GRC is about 0.6944 μs. As such, the charging time can be secured by grouping the gate lines and the pixel units into a plurality of groups to activate two or more gate lines simultaneously in each scan period.

Referring to FIG. 15, one frame period FP includes S sub frame periods SFP1~SFPS. The sub frame periods SFP1~SFPS can have different emission times and the grayscale of the display data can be represented through the different emission times. The first gate driver 121*b* in FIG. 13 receives the first scan address signal SCIN1 to drive and activate one gate line among the gate lines G1~Gn−m of the first group GRA. In addition, the second gate driver 122*b* in FIG. 13 receives the second scan address signal SCIN2 and divides the one scan period into the first and second half scan periods to drive and activate one gate line among the gate lines Gn−m+1~Gn of the second group GRB and one gate line among the gate lines Gn+1~Gm+n−1 of the third group GRC sequentially. Thus the first gate driver 121*b* can drive the gate lines of the first group GRA in the PESS scheme, and the second driver 122*b* can drive the gate lines of the second group GRB in the PESS scheme and simultaneously drive the gate lines of the third group GRC in the PESS scheme.

Figure 16:
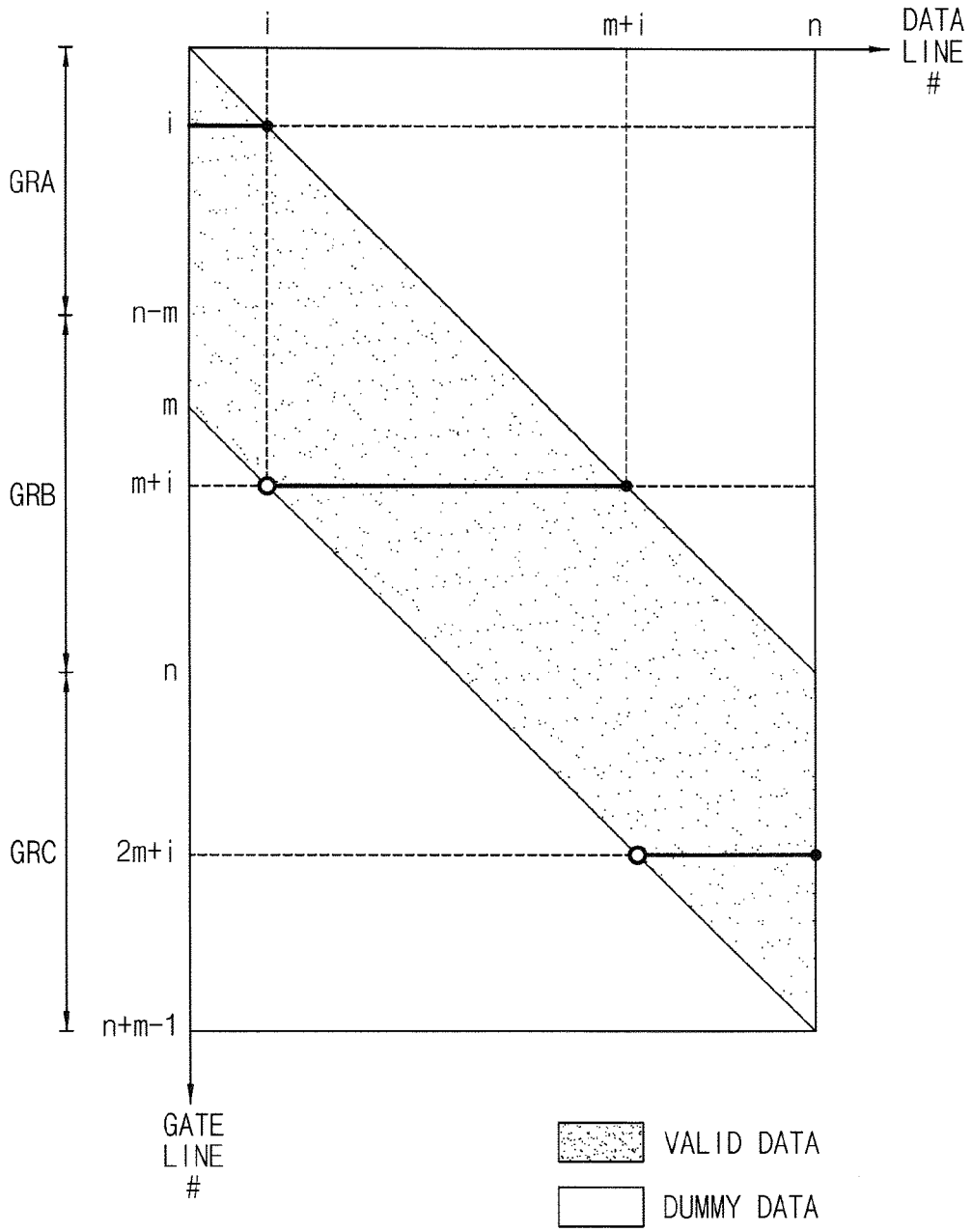
FIG. 16 is a diagram for describing an example of data application in a method of single-side driving according to example embodiments.

FIG. 16 is a diagram for describing an example of data application in a method of single-side driving according to example embodiments.

In FIG. 16, the horizontal axis represents the number of the data line and the vertical axis represents the number of the gate line. As described above, if the number of the rows of the pixel units is m and the number of the columns is n, the total number of the gate lines becomes m+n−1.

In case of the example embodiment described with reference to FIGS. 13, 14 and 15, the three gate lines, that is, one of the first group GRA, one of the second group GRB and one of the third group GRC, are activated for each scan period. In this case, the valid data signals are applied to all of the data lines D1~Dn for each scan period. In FIG. 16, the dotted region represents the application of the valid data and the other region represents the application of the dummy data.

For example, when the (m+i)-th gate line Gm+i (where i is zero or a positive integer less than m) of the second group GRB is selected and activated, the (i)-th gate line Gi of the first group GRA and the (2m+i)-th gate line of the third group GRC are selected and activated together. In this case, the valid data on the first through (i)-th data lines D1~Di are transferred to the pixel units of the first group GRA, the valid data on the (i+1)-th through (m+i)-th data lines Di+1~Dm+i are transferred to the pixel units of the second group GRB and the valid data on the (m+i+1)-th through (n)-th data lines Dm+i+1~Dn are transferred to the pixel units of the third group GRC.

As such, the data rate can be reduced and the charging time can be secured by grouping the gate lines and the pixel units into a plurality of groups to activate two or more gate lines simultaneously or concurrently in each scan period.

Figure 17:
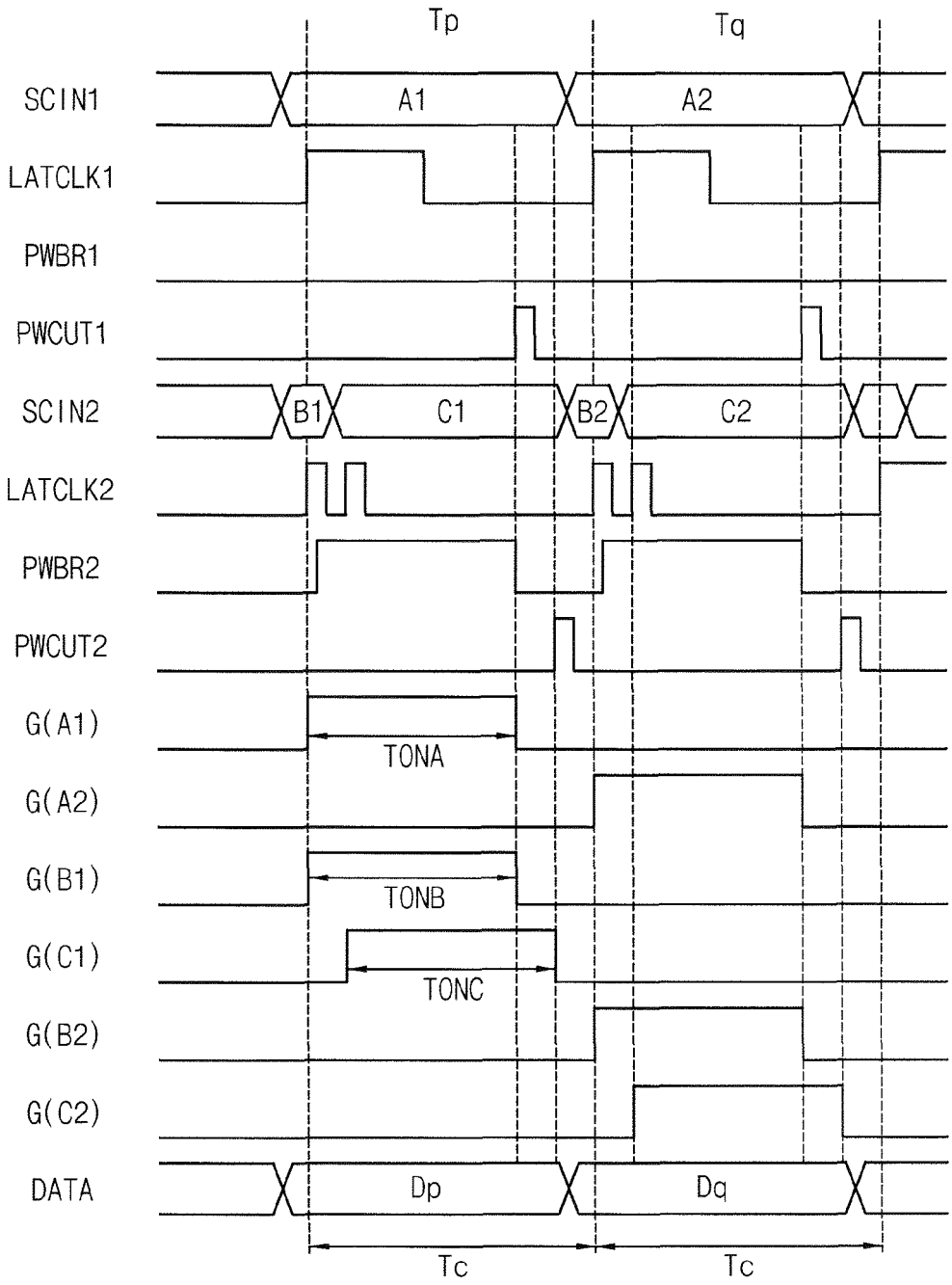
FIG. 17 is a diagram illustrating a method of single-side driving using the gate driver of FIG. 13 according to example embodiments.

FIG. 17 is a diagram illustrating a method of single-side driving using the gate driver of FIG. 13 according to example embodiments.

FIG. 17 illustrates the scan driving control signals SCIN1, SCIN2, LATCK1, LATCK2, PWBR1, PWBR2, PWCUT1 and PWCUT2, gate signals G(A1), G(A2), G(B1), G(B2), G(C1) and G(C2) and data Dp and Dq with respect to a first scan period Tp and a second scan period Tq. In some embodiments, the first and second scan periods Tp and Tq are not consecutive periods and the other scan periods can exist between the first and second scan periods Tp and Tq.

In FIGS. 17, A1 and A2 represent the numbers of the gate lines in the first group GRA, B1 and B2 represent the numbers of the gate lines in the second group GRB, and C1 and C2 represent the numbers of the gate lines in the third group C1. G(A1) and G(A2) represent the gate signals applied to the A1 and A2 gate lines in the first group GRA, G(B1) and G(B2) represent the gate signals applied to the B1 and B2 gate lines in the second group GRB, and G(C1) and G(C2) represent the gate signals applied to the C1 and C2 gate lines in the third group GRA.

The first gate driver 121*b* in FIG. 13 can drive and activate one gate line among the gate lines G1~Gn−m of the first group GRA for each scan period as illustrated in FIG. 17. In addition, the second gate driver 122*b* in FIG. 13 can drive and activate one gate line among the gate lines Gn−m+1~Gn of the second group GRB and one gate line among the gate lines Gn+1~Gm+n−1 of the third group GRC for each scan period as illustrated in FIG. 17. The first pulse width broadening signal PWBR1 is deactivated in the logic low level and the second pulse width broadening signal PWBR2 can be activated in the logic high level. Accordingly the first gate driver 121*b* can activate one gate line at each time and the second gate driver 122*b* can activate two gate lines simultaneously or concurrently. As illustrated in FIG. 17, the second gate driver 122*b* overlaps at least a portion of an activation time of the gate line of the second group GRB and at least a portion of an activation time of the gate line of the third group GRC for each scan period.

In this case, the activation times TONA, TONB and TONC of the gate lines of the first, second and third groups GRA, GRB and GRC can be equal to each other. For example, in case of the full high definition (FHD), the number m of the rows is 1080, the number n of the columns is 1920 and the number m+n−1 of the gate lines is 2999. The number of the gate lines G1~Gn−m of the first group is 840, the number of the gate lines Gn−m+1~Gn is 1080 and the number of the gate lines Gn+1~Gm+n−1 is 1079. If the frame rate is about 75 Hz, the number of sub frames for digital driving is 8 and the PESS scheme as described with reference to FIG. 11 is applied, the time TC of the one scan period corresponds to about 1.5432 μs. If the duty ratio of the gate signal is about 80%, each of the activation times TONA, TONB and TONC of the gate lines of the first, second and third groups GRA, GRB and GRC is about 1.2346 μs. As such, the charging time can be secured by grouping the gate lines and the pixel units into a plurality of groups to activate two or more gate lines simultaneously in each scan period.

Figure 18A:
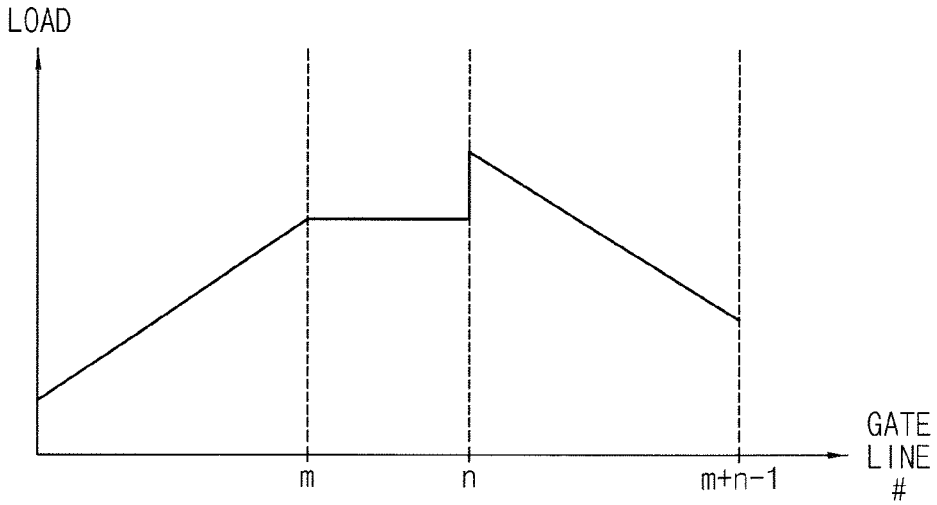
FIGS. 18A and 18B are diagrams illustrating an example variation of charging time depending on loads of gate lines.
Figure 18B:
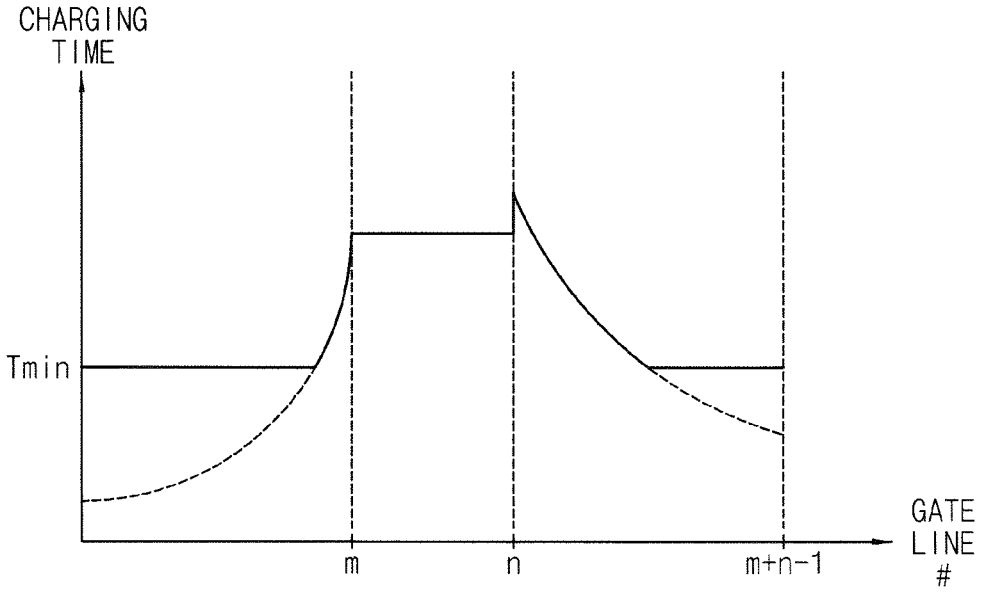

FIGS. 18A and 18B are diagrams illustrating an example variation of charging time depending on loads of gate lines.

Referring to FIGS. 18A and 18B, the number of the pixel units connected commonly to one gate line is increased gradually as the number of the gate line is increased with respect to the first gate line G1 to the (m)-th gate line Gm. The load of the gate line is increased gradually and thus the charging time is required to be increased gradually. With respect to the (m)-th gate line Gm to the (n)-th gate line Gn, the number of the pixel units connected commonly to one gate line can be maintained and thus the charging time can be fixed.

With respect to the gate lines Gn+1~Gm+n−1 of the third group GRC, as described with reference to FIGS. 3 and 7A, the loads of the gate lines are further increased because the vertical gate lines are added to connect the diagonal gate lined to the gate driver. The number of the pixel units connected commonly to one gate line can be decreased gradually as the number of the gate line is increased with respect to the gate lines Gn+1~Gm+n−1 of the third group. The load of the gate line is decreased gradually and thus the charging time is required to be decreased gradually. As illustrated in FIG. 18B, the charging time is limited to a minimum time Tmin according to the data rate of the data driver.

Figure 19:
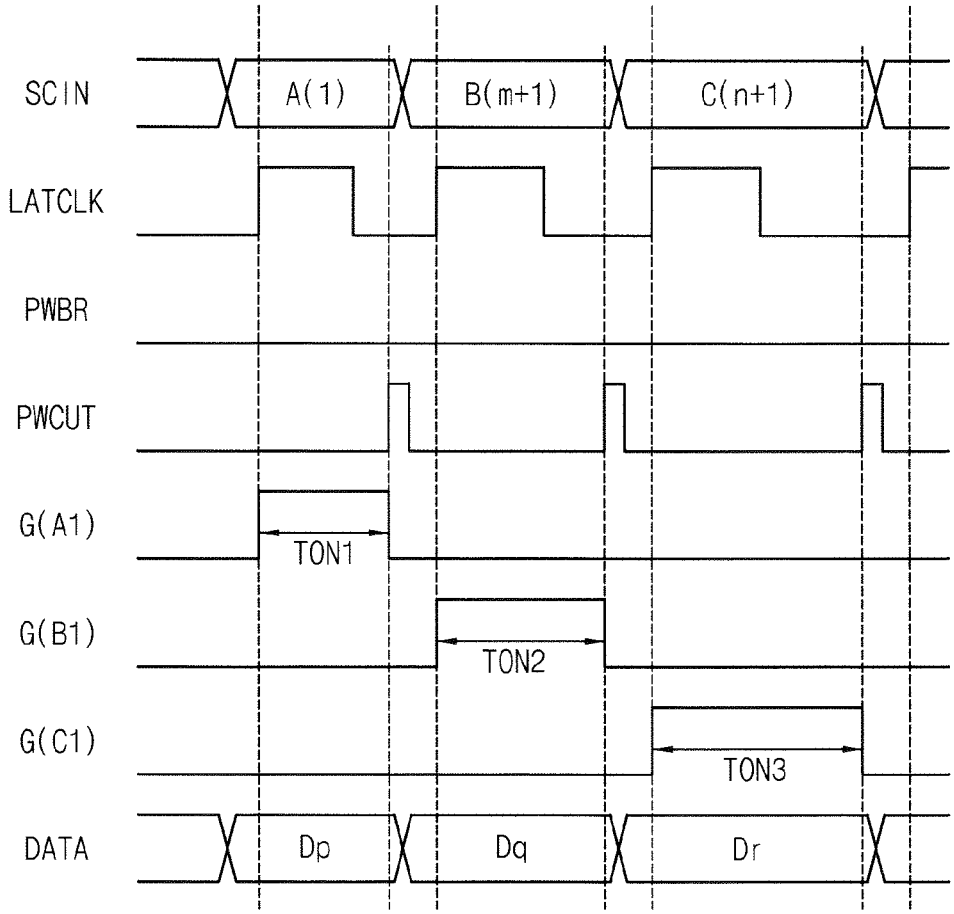
FIG. 19 is a diagram illustrating a method of single-side driving according to example embodiments.

FIG. 19 is a diagram illustrating a method of single-side driving according to example embodiments.

FIG. 19 illustrates the scan driving control signals SCIN, LATCK, PWBR and PWCUT, gate signals G(A1), G(Bm+1) and G(Cn+1) and data Dp, Dq and Dr with respect to a first scan period Tp, a second scan period Tq and a third scan period Tr. In some embodiments, the first, second and third scan periods Tp, Tq and Tr are not consecutive periods and the other scan periods exist between the first and second scan periods Tp and Tq and/or between the second and third scan periods Tq and Tr.

In FIG. 19, A1 represents the number of the gate line in the first group GRA, Bm+1 represents the number of the gate line in the second group GRB, and Cn+1 represents the number of the gate line in the third group C1. G(A1) represents the gate signal applied to the A1 gate line in the first group GRA, G(Bm+1) represents the gate signal applied to the Bm+1 gate line in the second group GRB, and G(Cn+1) represents the gate signal applied to the Cn+1 gate line in the third group GRA.

For each scan period, one gate line among the gate lines G1~Gm+n−1 of the first, second and third groups GRA, GRB and GRB can be driven and activated as illustrated in FIG. 19. The pulse width broadening signal PWBR is deactivated in the logic low level and thus one gate line can be activated at each time. In this case, the activation times TON1, TON2 and TON3 of the gate lines of the respective groups GRA, GRB and GRC can be varied depending on the loads of the gate lines, as described with reference to FIGS. 18A and 18B. In FIG. 19, TON1 can correspond to the minimum time Tmin in FIG. 18B, TON2 can correspond to the fixed charging time of the second group GRB and TON3 can correspond to the longest charging time of the (m+1)-th gate line of the third group GRC.

Figure 20:
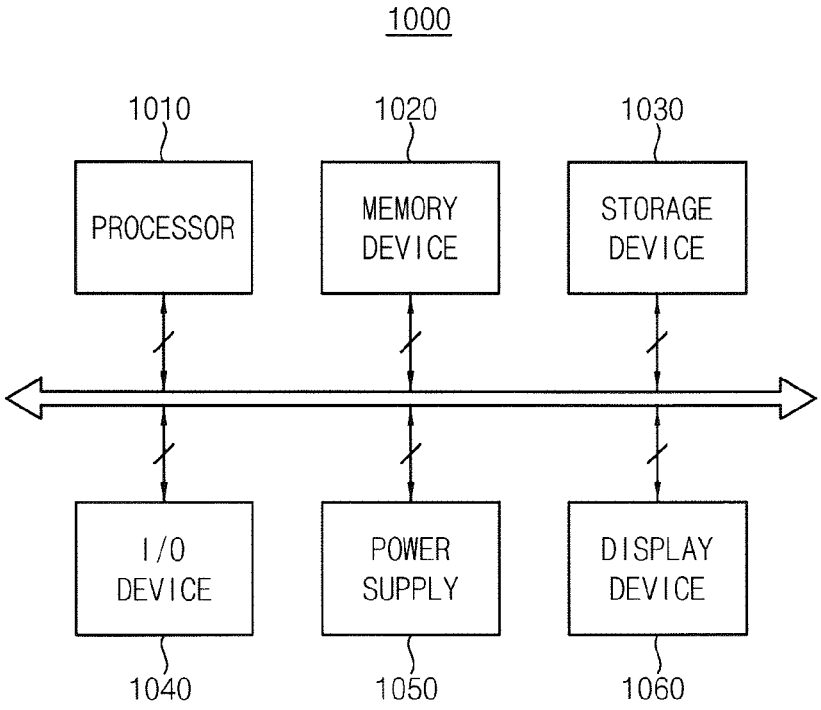
FIG. 20 is a block diagram illustrating an electronic device according to example embodiments.

FIG. 20 is a block diagram illustrating an electronic device according to example embodiments.

Referring to FIG. 20, an electronic device 1000 includes a processor 1010, a memory device 1020, a storage device 1030, an input/output (I/O) device 1040, a power supply 1050, and a display device 1060. In addition, the electronic device 1000 can include a plurality of ports for communicating a video card, a sound card, a memory card, a universal serial bus (USB) device, other electronic devices, etc.

The processor 1010 can perform various computing functions. The processor 1010 can be a microprocessor, a central processing unit (CPU), etc. The processor 1010 can be coupled to other components via an address bus, a control bus, a data bus, etc. Further, the processor 1010 can be coupled to an extended bus, such as a peripheral component interconnection (PCI) bus.

The memory device 1020 can store data for operations of the electronic device 1000. For example, the memory device 1020 includes at least one non-volatile memory device, such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device, such as a dynamic random access memory (DRAM) device, a static random access memory (SRAM) device, a mobile dynamic random access memory (mobile DRAM) device, etc. The storage device 1030 can be a solid state drive (SSD) device, a hard disk drive (HDD) device, a CD-ROM device, etc.

The I/O device 1040 can be an input device such as a keyboard, a keypad, a mouse, a touchpad, a touch-screen, a remote controller, etc., and an output device such as a printer, a speaker, etc. In some embodiments, the display device 1060 is included in the I/O device 1040. The power supply 1050 can provide a power for operations of the electronic device 1000. The display device 1060 can communicate with other components via the buses or other communication links.

As described above with reference to FIGS. 1 through 19, the display device 1060 can have a structure for performing the single-sided driving method. The display device 1060 includes a display panel, a data driver and a gate driver. The display panel includes a plurality of pixel units connected to a plurality of data lines and a plurality of gate lines, and the plurality of pixel units are arranged in a matrix form of a plurality of rows and a plurality of columns. The pixel units in the same column are connected commonly to the same data line, and the pixel units in the same diagonal line are connected commonly to the same gate line. The data driver and the gate driver are formed together at the same side of the display panel to drive the data lines and the gate lines, respectively.

The electronic device 1000 can be any device including a display device. For example, the electronic device 1000 is a television, a computer monitor, a laptop, a digital camera, a cellular phone, a smart phone, a personal digital assistant (PDA), a portable multimedia player (PMP), an MP3 player, a navigation system, or a video phone.

Figure 21:
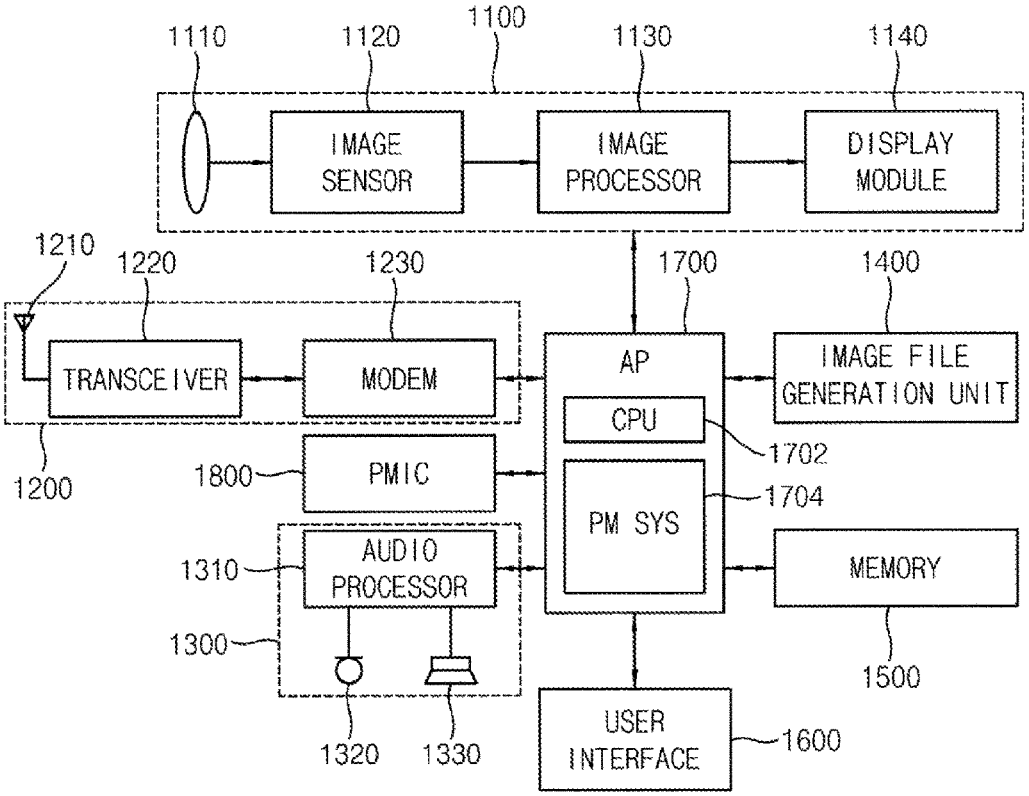
FIG. 21 is a block diagram illustrating a portable terminal according to example embodiments.

FIG. 21 is a block diagram illustrating a portable terminal according to example embodiments.

Referring to FIG. 21, a portable terminal 2000 includes an image processing block 1100, a wireless transceiving block 1200, an audio processing block 1300, an image file generation unit 1400, a memory device 1500, a user interface 1600, an application processor 1700, and a power management integrated circuit (PMIC) 1800.

The image processing block 1100 includes a lens 1110, an image sensor 1120, an image processor 1130, and a display module 1140. The wireless transceiving block 1200 includes an antenna 1210, a transceiver 1220 and a modem 1230. The audio processing block 1300 includes an audio processor 1310, a microphone 1320 and a speaker 1330.

As described above with reference to FIGS. 1 through 19, the display module 1140 can have a structure for performing the single-side driving method. The display module 1140 includes a display panel, a data driver and a gate driver. The display panel includes a plurality of pixel units connected to a plurality of data lines and a plurality of gate lines, and the plurality of pixel units are arranged in a matrix form of a plurality of rows and a plurality of columns. The pixel units in the same column are connected commonly to the same data line, and the pixel units in the same diagonal line are connected commonly to the same gate line. The data driver and the gate driver are formed together at the same side of the display panel to drive the data lines and the gate lines, respectively.

The portable terminal 2000 can include various kinds of semiconductor devices. For example, the application processor 1700 has low power consumption and high performance. The application processor 1700 can have multiple cores. In some embodiments, the application processor 1700 includes a CPU core 1702 and a power management (PM) system 1704.

The PMIC 1800 can provide driving voltages to the image processing block 1100, the wireless transceiving block 1200, the audio processing block 1300, the image file generation unit 1400, the memory device 1500, the user interface 1600 and the application processor 1700, respectively.

As described above, according to at least one of the disclosed embodiments, the electroluminescent display and the single-side driving method can reduce the bezel width by disposing the data driver and the gate driver together at the same side of the display panel. In addition, the electroluminescent display device and the single-side driving method can improve degradation of image quality at a right-bottom portion of the display panel by adopting the digital driving method that represents grayscale through light emission time instead of magnitude of a driving voltage. Further the electroluminescent display and the single-side driving method can reduce data rate and secure charging time by grouping the pixel units in the display panel that is driven by the single-side driving method.

The above described embodiments can be applied to various kinds of devices and systems such as mobile phones, smartphones, tablet computers, laptop computers, personal digital assistants (PDAs), portable multimedia players (PMPs), digital televisions, digital cameras, portable game consoles, music players, camcorders, video players, navigation systems, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. An electroluminescent display comprising: a display panel including a plurality of pixel units electrically connected to a plurality of data lines and a plurality of gate lines, wherein the pixel units are arranged in a matrix of a plurality of rows and a plurality of columns, wherein the pixel units in the same column are connected to the same data line, and wherein the pixel units in the same diagonal line of the matrix are connected to the same gate line;

a data driver located at a first side of the display panel, wherein the data driver is configured to drive the data lines; and a gate driver located at the first side of the display panel and configured to drive the gate lines;

wherein the rows include m rows, wherein the columns include n columns where m is a positive integer and n is a positive integer greater than m, and wherein the pixel units in the (i)-th row and in the (j)-th column are electrically connected to the (i+j−1)-th gate line where i is a positive integer equal to or less than m, and j is a positive integer equal to or less than n;

wherein the gate lines include an (n)-th gate line and an (m+n−1)-th gate line, wherein each of the first through (n)-th gate lines respectively includes a plurality of portions of a first diagonal gate line, wherein the first diagonal gate line is connected to the gate driver at the first side of the display panel and extends in a diagonal direction, and wherein each of the (n+1)-th gate line through the (m+n−1)-th gate line respectively includes i) a plurality of portions of a vertical gate line, wherein the vertical gate line is connected to the gate driver at the first side of the display panel and extends in a column direction and ii) a plurality of portions of a second diagonal line, wherein the second diagonal line is connected to the vertical gate line at a second side of the display panel and extends in the diagonal direction, and wherein the second side opposes the first side.

2. The electroluminescent display of claim 1, wherein the first gate line through the (m+n−1)-th gate line are grouped into a first group including the first gate line through the (n−m)-th gate line, a second group including the (n−m+1)-th gate line through the (n)-th gate line, and a third group including the (n+1)-th gate line through the (n+m−1)-th gate line.

3. The electroluminescent display of claim 2, wherein the gate driver includes:

a first gate driver configured to drive the gate lines of the first group; and a second gate driver configured to drive the gate lines of the second and third groups.

4. The electroluminescent display of claim 3, wherein the first and second gate drivers are configured to receive the same scan address signal and latch clock signal to drive and activate a selected gate line of the first, second and third groups during a scan period.

5. The electroluminescent display of claim 4, wherein the first and second gate drivers are configured to drive the gate lines of the first, second and third groups in progressive emission with simultaneous scan (PESS) scheme.

6. The electroluminescent display of claim 4, wherein activation times of the first gate line through the (m+n−1)-th gate line are substantially equal to each other.

7. The electroluminescent display of claim 4, wherein activation times of the first gate line through the (m+n−1)-th gate line vary based on loads on the gate lines.

8. The electroluminescent display of claim 4, wherein the data driver is further configured to i) provide one or more valid data signals to one or more of the data lines and ii) provide one or more dummy data signals to the other data lines during a scan period.

9. The electroluminescent display of claim 3, wherein the first gate driver is further configured to receive a first scan address signal and a first latch clock signal to drive and activate a selected gate line of the first group during a scan period, and wherein the second gate driver is further configured to receive a second scan address signal and a second latch clock signal to drive and activate a selected gate line of the second and third groups during the scan period.

10. The electroluminescent display of claim 9, wherein the first gate driver is further configured to drive the gate lines of the first group in the progressive emission with simultaneous scan (PESS) scheme, and wherein the second driver is configured to concurrently drive the gate lines of the second and third groups in the PESS scheme.

11. The electroluminescent display of claim 9, wherein the second driver is further configured to divide the scan period into first and second half scan periods, and wherein the second driver is further configured to i) drive and activate a selected gate line of the second group during the first half scan period and ii) drive and activate a selected gate line of the third group during the second half scan period.

12. The electroluminescent display of claim 9, wherein at least a portion of an activation time of the gate line of the second group and at least a portion of an activation time of the gate line of the third group overlap during a scan period.

13. The electroluminescent display of claim 9, wherein the data driver is further configured to provide a plurality of valid data signals to all of the data lines during a scan period.

14. The electroluminescent display of claim 1, wherein each data line includes red, green and blue data lines, wherein each pixel unit includes red, green and blue sub pixels respectively connected to the red, green and blue data lines, and wherein the red, green and blue sub pixels in the same unit pixel are connected to the same gate line.

15. A method of driving an electroluminescent display device comprising a plurality of pixel units connected to a plurality of data lines and a plurality of gate lines and arranged in a matrix form of a plurality of rows and the columns, the method comprising:

electrically connecting the pixel units in the same column to the same data line;

electrically connecting the pixel units in the same diagonal line of the matrix to the same gate line;

driving the data lines with a data driver located at a first side of a display panel of the electroluminescent display; and driving the gate lines with a gate driver located at the first side of the display panel;

wherein the rows include m rows, wherein the columns include n columns where m is a positive integer and n is a positive integer greater than m, and wherein the electrical connecting of the pixel units in the same diagonal line includes: electrically connecting the pixel units in a (i)-th row and in a (j)-th column to a (i+j−1)-th gate line where i is a positive integer equal to or less than m and j is a positive integer equal to or less than n;

wherein the gate lines include an (n)-th gate line and an (m+n−1)-th gate line, wherein each of the first through (n)-th gate lines respectively includes a plurality of portions of a first diagonal gate line, wherein the first diagonal gate line is connected to the gate driver at the first side of the display panel and extends in a diagonal direction, and wherein each of the (n+1)-th gate line and the (m+n−1)-th gate line respectively includes i) a plurality of portions of a vertical gate line, wherein the vertical gate line is connected to the gate driver at the first side of the display panel and extends in a column direction and ii) a plurality of portions of a second diagonal line, wherein the second diagonal line is connected to the vertical gate line at a second side of the display panel and extends in the diagonal direction.

16. The method of claim 15, wherein the first gate line through the (m+n−1)-th gate line are grouped into a first group including the first gate line through the (n−m)-th gate line, a second group including the (n−m+1)-th gate line through the (n)-th gate line, and a third group including the (n+1)-th gate line through the (n+m−1)-th gate line, and wherein the driving of the gate lines includes: electrically connecting the first group to a first gate driver to drive the gate lines of the first group; and electrically connecting the second and third groups to a second gate driver to drive the gate lines of the second and third groups.

* * * * *